US006164442A

United States Patent [19]

Stravitz

[11] Patent Number: 6,164,442

[45] Date of Patent: Dec. 26, 2000

[54] MULTI-PART, MULTI-FOLD, MULTI-COMPARTMENT PORTABLE CARRYING AND STORAGE CASE

[76] Inventor: David M. Stravitz, 16 Park Ave. - Suite 14A, New York, N.Y. 10016

[21] Appl. No.: 09/377,266

[22] Filed: Aug. 19, 1999

[51] Int. Cl.[7] ..... B65D 71/00; A45C 11/24

[52] U.S. Cl. ..... 206/233; 206/37; 206/38; 220/522; 221/45; 221/62

[58] Field of Search ..... 206/37, 38, 233, 206/235, 494; 221/45, 62, 186, 188; 220/826, 833, 835, 521, 522

[56] References Cited

U.S. PATENT DOCUMENTS

| | | | |
|---|---|---|---|
| D. 157,738 | 3/1950 | Chase | 206/233 X |
| 2,559,528 | 7/1951 | Barnett | 206/37 X |
| 2,604,205 | 7/1952 | Patterson | 206/37 X |
| 2,685,363 | 8/1954 | Falk et al. | 220/522 X |
| 3,317,097 | 5/1967 | Giordano | 220/835 X |
| 3,511,433 | 5/1970 | Andrews et al. | 220/833 X |
| 3,732,955 | 5/1973 | Carter et al. | 206/233 X |
| 3,933,296 | 1/1976 | Ruskin et al. | 220/826 X |
| 4,185,753 | 1/1980 | Leto | 221/45 |
| 5,915,548 | 6/1999 | Sasaki | 220/522 X |

*Primary Examiner*—Bryon P. Gehman
*Attorney, Agent, or Firm*—Frishauf, Holtz, Goodman, Langer & Chick, P.C.

[57] ABSTRACT

A multi-part, multi-fold, multi-compartment portable carrying and storage case, includes a lower case section including a first bottom wall and a first peripheral wall upstanding from a peripheral edge of the first bottom wall. A first storage compartment is defined within the first peripheral wall and the first bottom wall. A case cover is hingedly connected with the lower case section, the case cover including a lower half shell and a half shell cover. The lower half shell is hingedly connected with the lower case section for covering and closing the first storage compartment. The lower half shell includes a second bottom wall and a second peripheral wall upstanding from a peripheral edge of the second bottom wall, with a second storage compartment defined within the second peripheral wall and the second bottom wall. A half shell cover is hingedly connected with the lower half shell for covering and closing the second storage compartment.

14 Claims, 17 Drawing Sheets

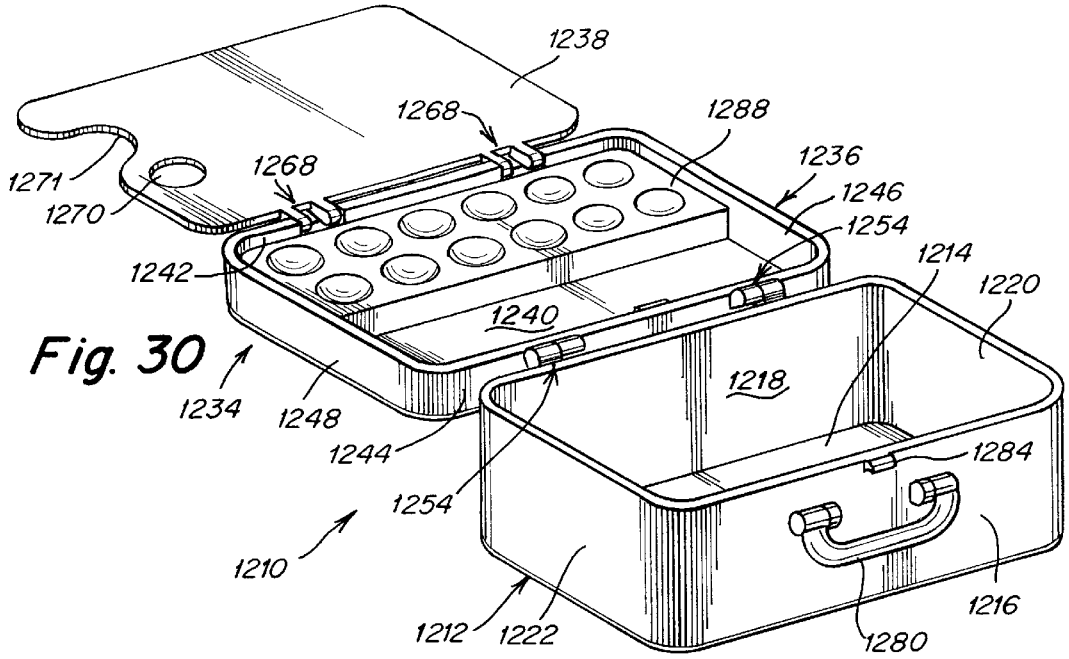
Fig. 30
Fig. 31
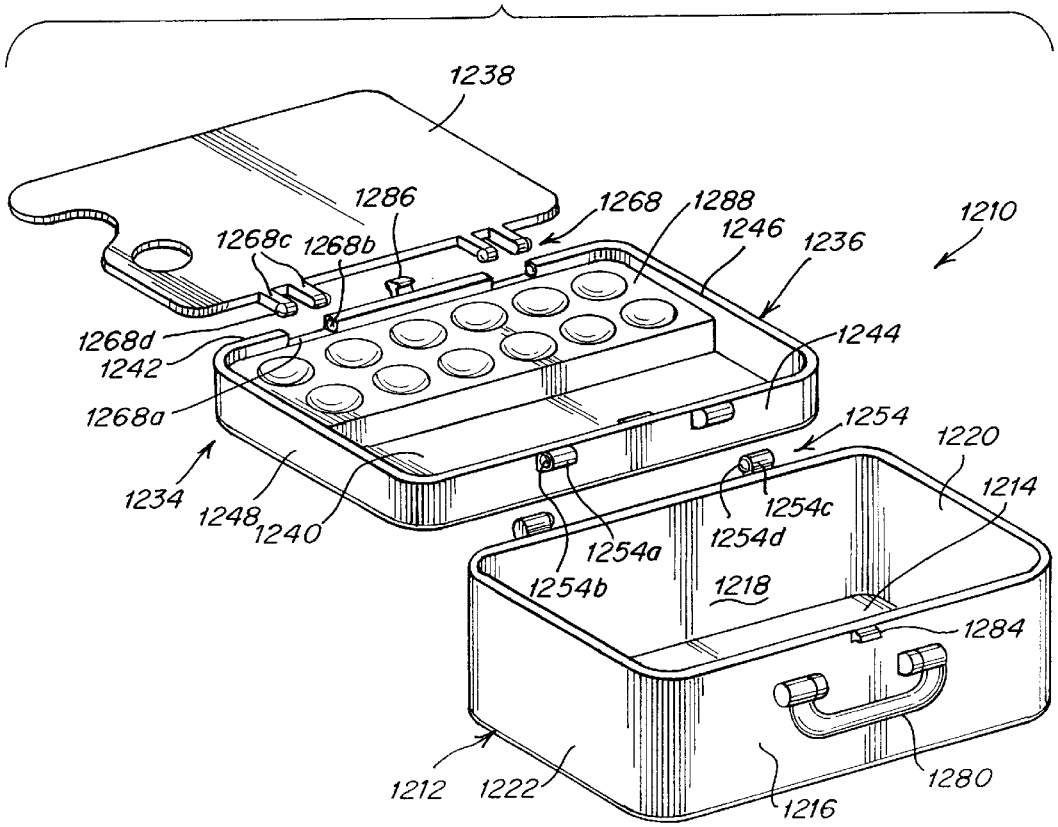

MULTI-PART, MULTI-FOLD, MULTI-COMPARTMENT PORTABLE CARRYING AND STORAGE CASE

BACKGROUND OF THE INVENTION

The present invention relates generally to portable carrying and/or storage cases, and more particularly, is directed to portable carrying and/or storage cases having multiple compartments including at least upper and lower compartments arranged in a multi-part, multi-fold arrangement.

In many instances, it is desirable to carry wet or moist tissues in a purse or the like. Wet or moist tissue packages are known with resealable flaps. However, when the last tissue is used, the water-tight package must be discarded, resulting in waste and adding to the cost of the tissues.

Further, in many instances, it is desirable to place numerous items in a compact carrying and storage case. For example, it may be desirable to carry both wet tissues and diapers in the same compact, substantially liquid-tight carrying case.

Other examples of different items which are desired to be carried in a single case having multiple compartments are, for example, artist's paints and supplies; file folders, computer disks and business supplies; spool threads and thread or sewing accessories; foodstuffs, etc.

However, there is presently no single multi-compartment case that is portable and compact, and that can be molded in a single operation with at least two sets of hinges, in order to accommodate these requirements.

SUMMARY OF THE INVENTION

Accordingly, it is an object of the present invention to provide a portable carrying and/or storage case that overcomes the aforementioned problems with the prior art.

It is another object of the present invention to provide a multi-part, multi-fold, multi-compartment portable carrying and/or storage case that can be molded entirely in a single molding operation.

It is still another object of the present invention to provide such a portable carrying and/or storage case that is molded to provide at least a tri-part, dual-fold case.

It is yet another object of the present invention to provide a portable carrying and/or storage case that is easy and economical to manufacture and use and which can be adapted to many uses.

In accordance with an aspect of the present invention, a multi-part, multi-fold, multi-compartment portable carrying and/or storage case, includes a lower case section including a first bottom wall and a first peripheral wall upstanding from a peripheral edge of the first bottom wall. A first storage compartment is defined within the first peripheral wall and the first bottom wall. A case cover is hingedly connected with the lower case section, the case cover including a lower half shell and a half shell cover. The lower half shell is hingedly connected with the lower case section for covering and closing the first storage compartment. The lower half shell includes a second bottom wall and a second peripheral wall upstanding from a peripheral edge of the second bottom wall, with a second storage compartment defined within the second peripheral wall and the second bottom wall. A half shell cover is hingedly connected with the lower half shell for covering and closing the second compartment.

An arrangement is provided for releasably securing (locking) the half shell cover to the lower half shell in a closed condition. Also, an arrangement is provided for releasably securing the case cover to the lower case section in a closed condition.

The case cover is hingedly connected with the lower case section and the lower half shell is hingedly connected with the half shell cover by either living hinges or detachable hinges.

In one embodiment, the half shell cover includes an elongated recess for removing tissues, wipes or other similar dispensable items in the lower half shell.

The half shell cover can be a planar member that seats on top of the lower half shell, or can include a third bottom wall and a third peripheral wall upstanding from a peripheral edge of the third bottom wall. In the latter case, the third peripheral wall can fit within the second peripheral wall, or can seat on top of the second peripheral wall.

In another embodiment, a clip is mounted within at least one of the lower half shell and the half shell cover.

In another embodiment, the lower half shell includes a peripheral ledge which seats on an upper surface of the first peripheral wall and with the second peripheral wall fitting within the first peripheral wall.

In still another embodiment, at least one partition is provided in one or both of the first compartment and the second compartment for dividing the respective compartment into a plurality of smaller compartments.

In yet another embodiment, the lower case section includes a plurality of posts extending upwardly from the second bottom wall, for holding a plurality of spools thereon.

In a further embodiment, the lower case section includes short stub posts adjacent the second peripheral wall for supporting a drop-in tray therein.

In a still further embodiment, there are two case covers hingedly connected at opposite sides of the first peripheral wall of the lower case section, each case cover including a lower half shell hingedly connected at one side of the first peripheral wall of the lower case section for covering and closing the first storage compartment, each lower half shell including a second bottom wall of approximately one-half the area of the first bottom wall, and a second peripheral wall upstanding from a peripheral edge of each the second bottom wall, with a second storage compartment defined within the each second peripheral wall and second bottom wall; and a half shell cover hingedly connected with each the lower half shell for covering and closing the second storage compartment.

In a yet further embodiment, an accordion style file section is mounted in the lower half shell. Preferably, the accordion style file section only occupies a portion of the lower half shell, and the lower half shell further includes a partition for dividing a remainder of the lower half shell into a plurality of smaller storage compartments. In such case, the half shell cover is dimensioned to only cover the smaller storage compartments.

A handle can also be provided on an outer surface of the first peripheral wall.

In another embodiment, a paint tray is provided in the lower half shell, and the half shell cover forms an artist's palette.

In accordance with another aspect of the present invention, a multi-part, multi-fold, multi-compartment portable carrying and storage case, includes a lower case section including a first bottom wall and a first peripheral wall upstanding from a peripheral edge of the first bottom wall, with a first storage compartment defined within the first peripheral wall and the first bottom wall. A half shell cover is hingedly connected to one side of the first peripheral wall of the lower half shell for covering and closing the first storage compartment. A case cover is hingedly connected to another side of the first peripheral wall of the lower half shell for overlying and covering the half shell cover, with the case cover including a second bottom wall and a second peripheral wall upstanding from a peripheral edge of the second bottom wall, and with the second peripheral wall receiving the half shell cover therein.

In such case, the half shell cover preferably includes a third bottom wall and a third peripheral wall that seats on the first peripheral wall. Also, there is preferably an arrangement for releasably securing (locking) the half shell cover to the lower half shell in a closed condition. In like manner, there is provided an arrangement for releasably holding (locking) the case cover to the half shell. In this embodiment, both the case cover and the half shell cover are hingedly connected with the lower half shell by living hinges. Also, the half shell cover includes an elongated recess for removing tissues, wipes or the like in the lower half shell.

In accordance with still another aspect of the present invention, a multi-part, multi-fold, multi-compartment portable carrying and storage case, includes a lower case section including a first bottom wall and a first peripheral wall upstanding from a peripheral edge of the first bottom wall, with a first storage compartment defined within the first peripheral wall and the first bottom wall. A case cover is hingedly connected with the lower case section, the case cover including a lower half shell and a half shell cover. The lower half shell is hingedly connected with the lower case section for covering and closing the first storage compartment. The lower half shell includes a second bottom wall and a second peripheral wall upstanding from a peripheral edge of the second bottom wall, with a second storage compartment defined within the second peripheral wall and the second bottom wall. The half shell cover is removably mounted within the lower half shell for dividing the second storage compartment into an upper storage compartment and a lower storage compartment.

In this embodiment, the lower half shell includes stops mounted therein for holding down the half shell cover therein.

The above and other objects, features and advantages of the present invention will become readily apparent from the following detailed description thereof which is to be read in connection with the accompanying drawings.

BRIEF DESCRIPTION THE DRAWINGS

Figure 17:
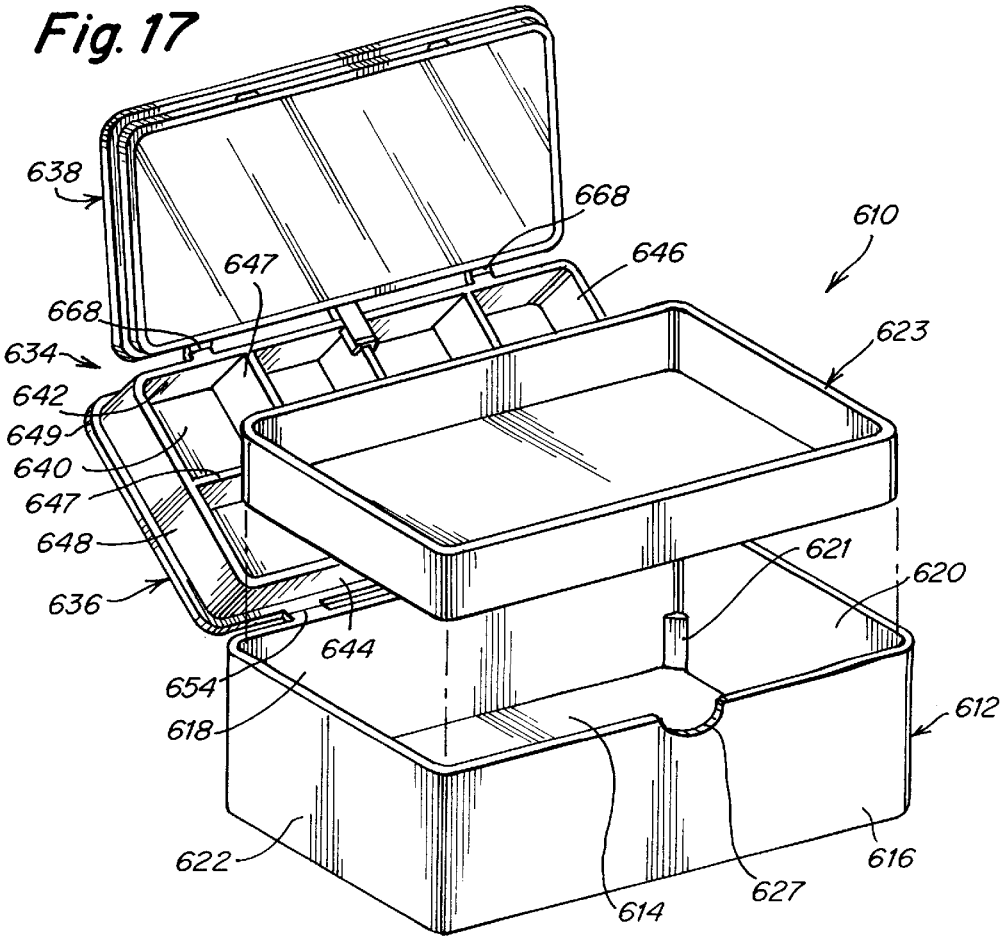
Figure 18:
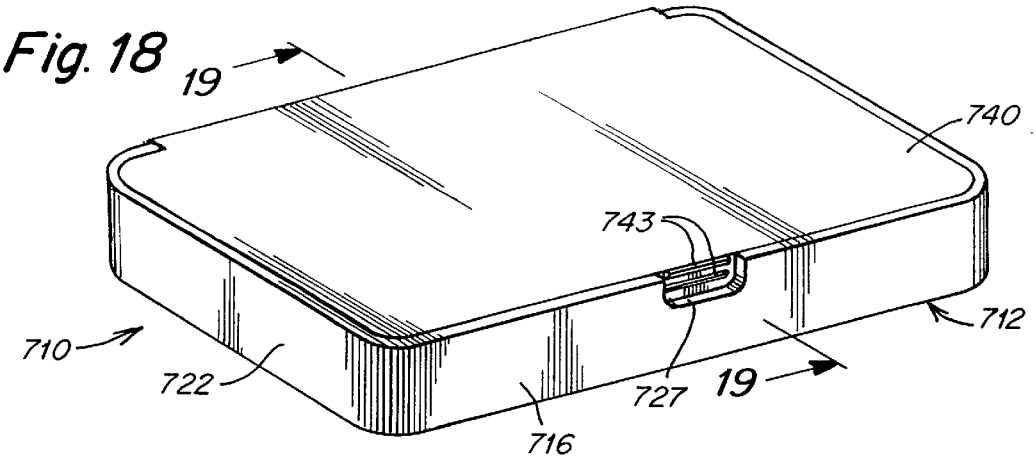
Figure 19:
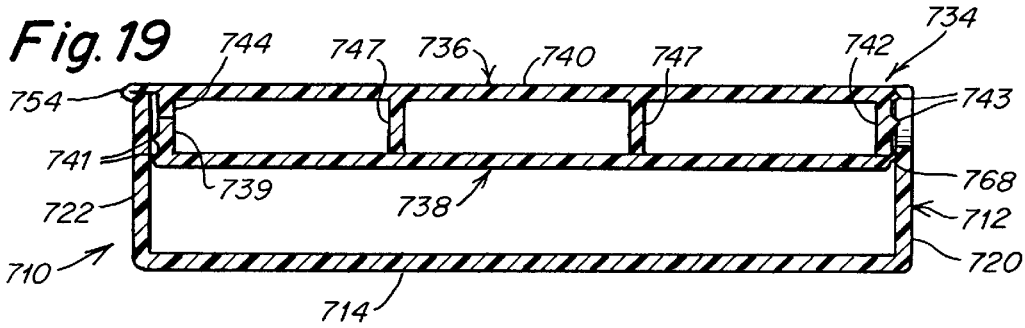
Figure 20:
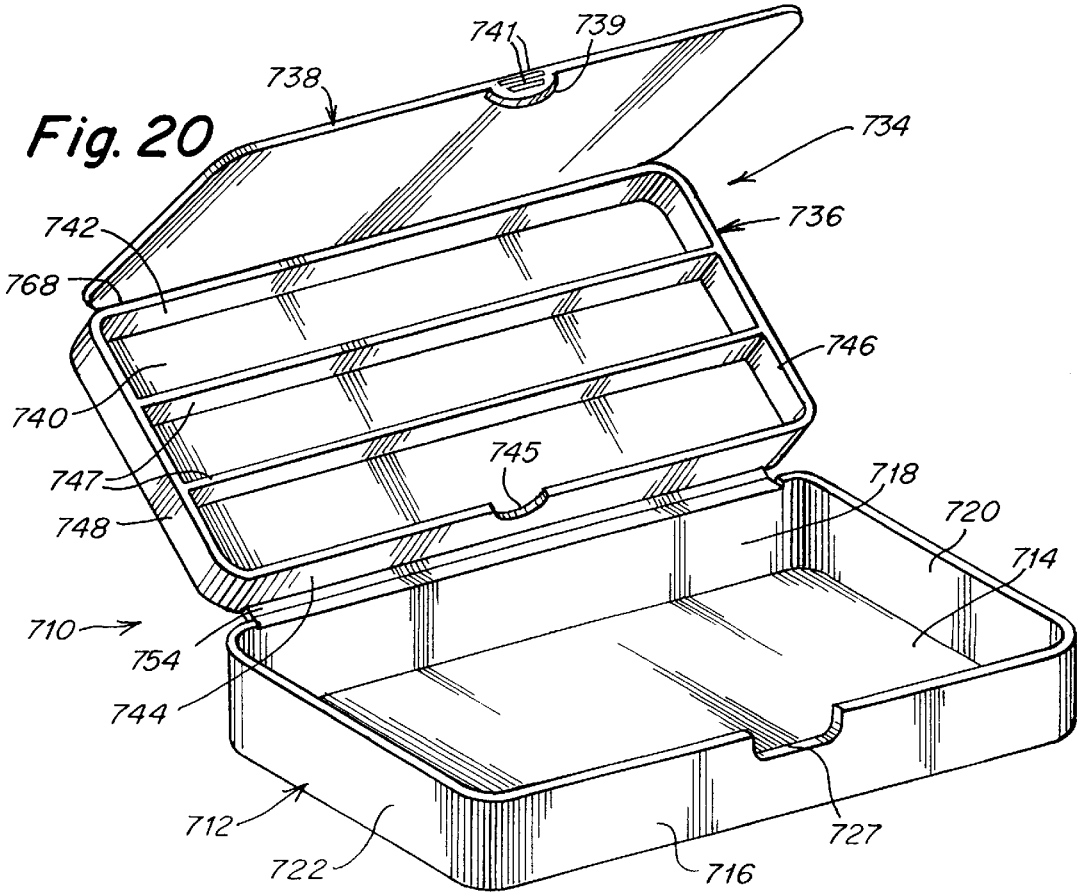
Figure 21:
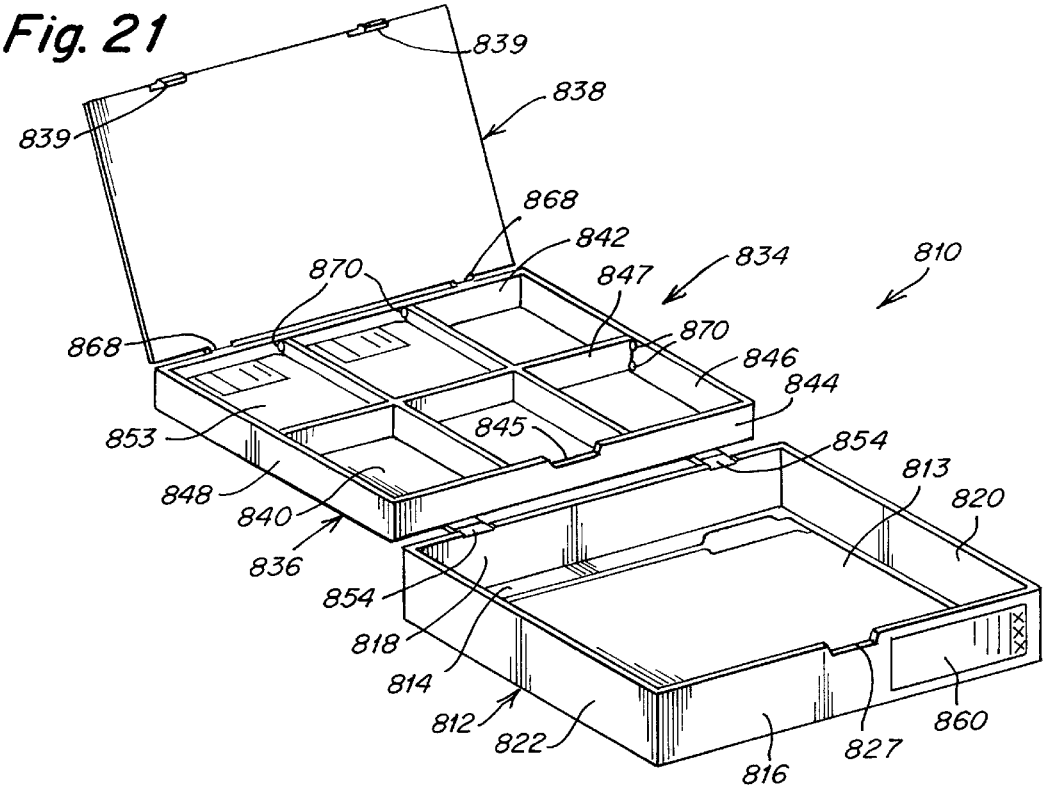
Figure 22:
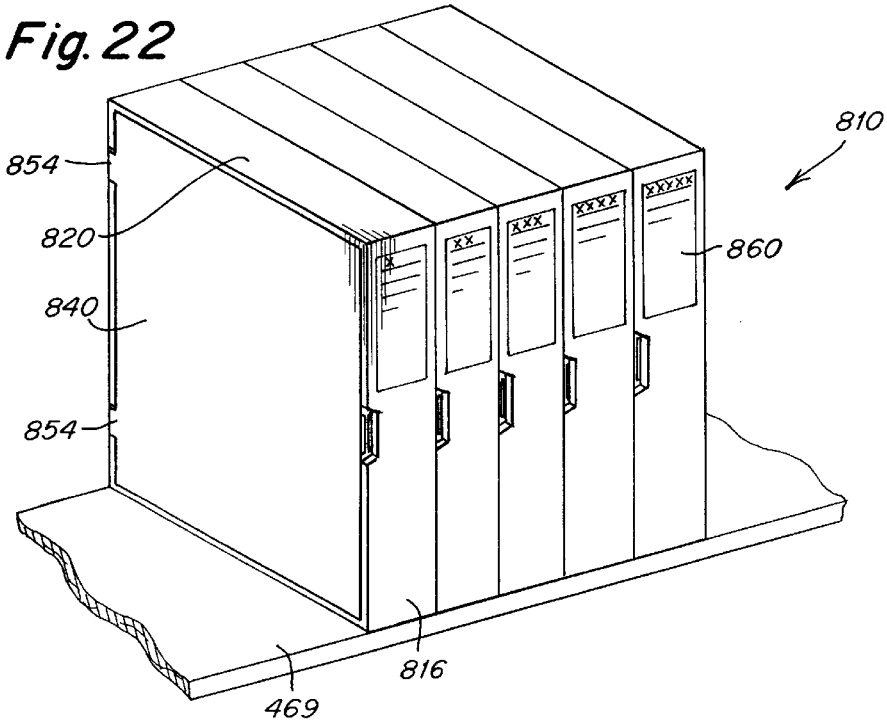
Figure 23:
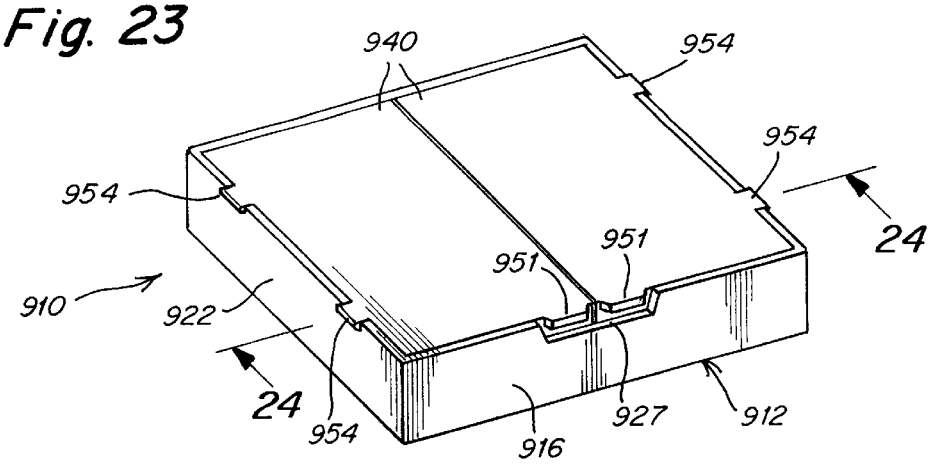
Figure 24:
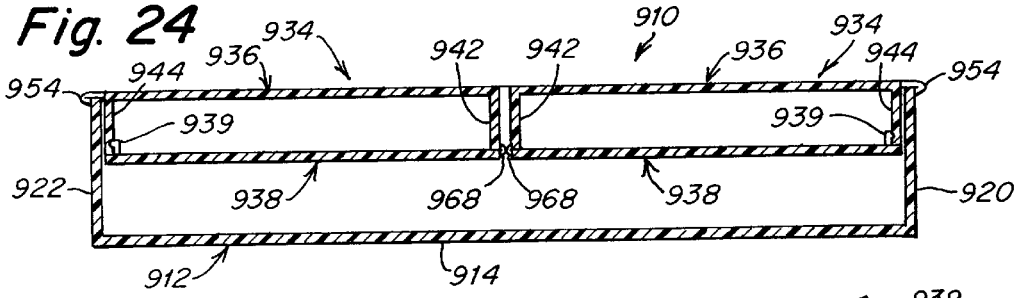
Figure 25:
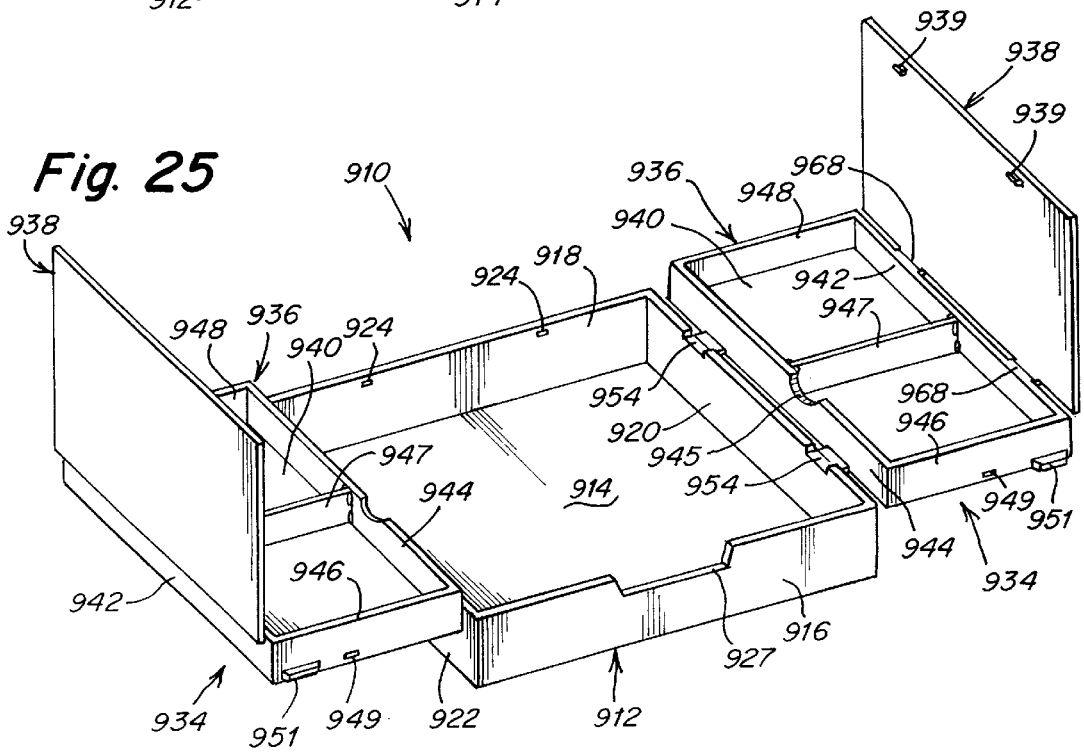
Figure 26:
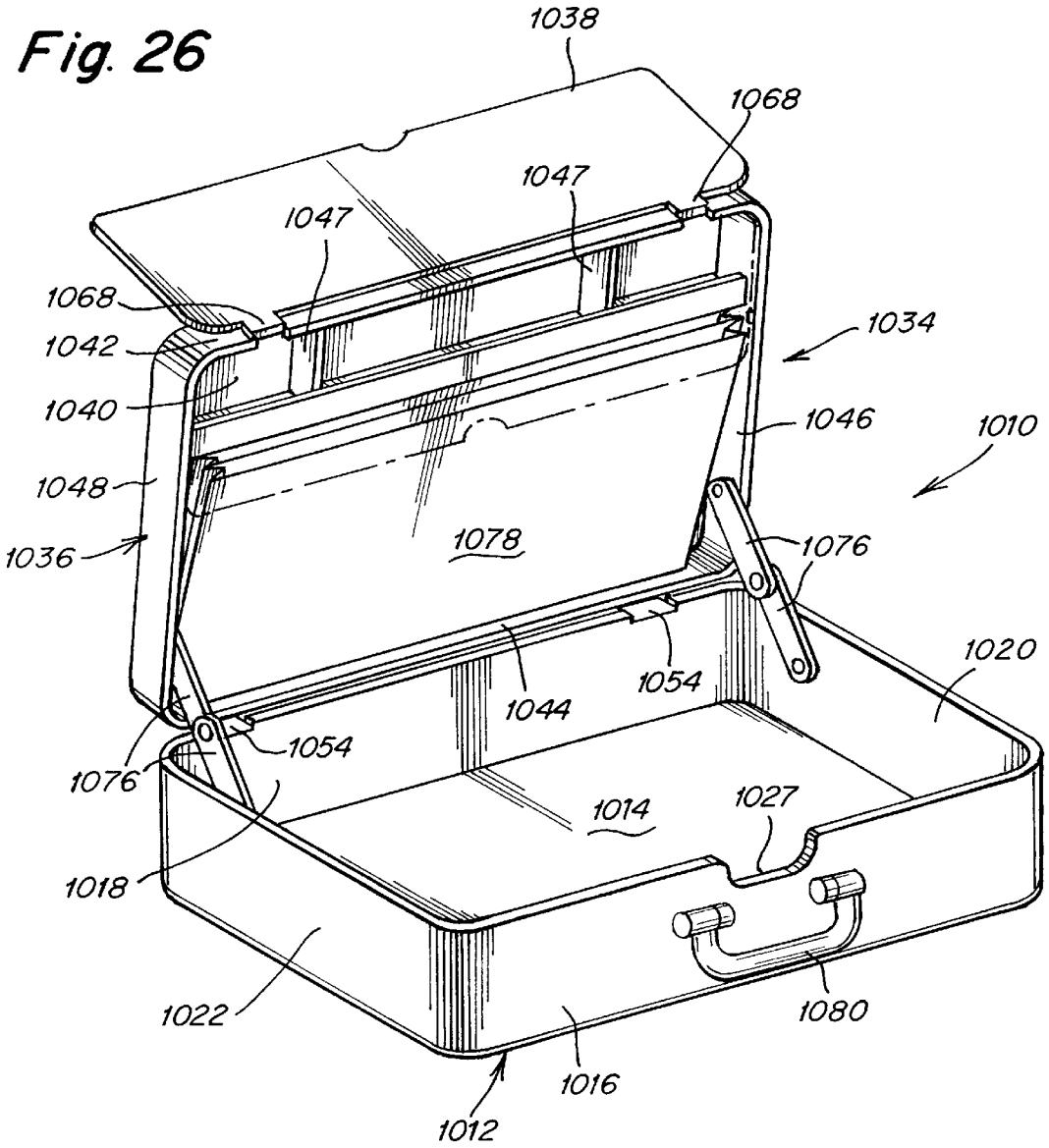
Figure 27:
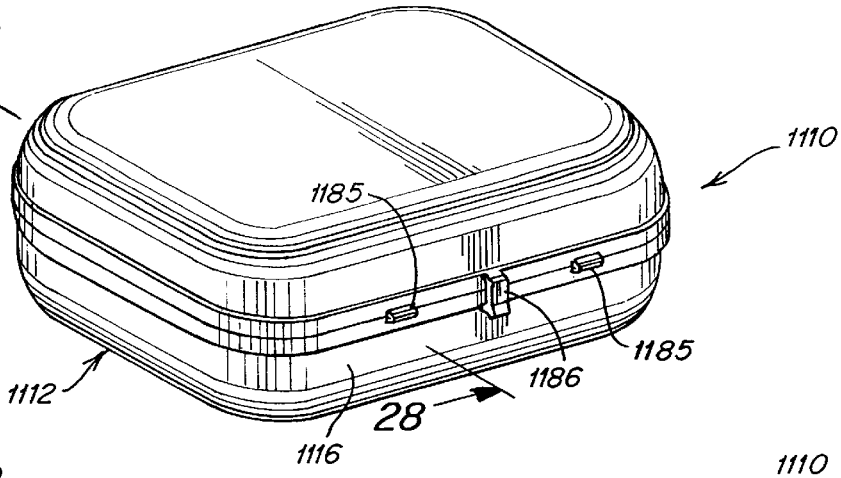
Figure 28:
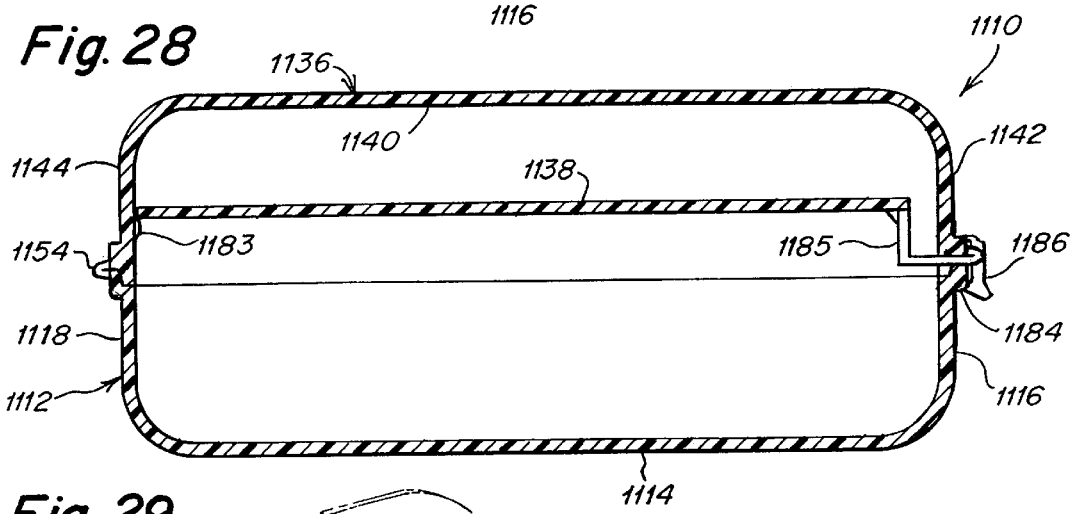
Figure 29:
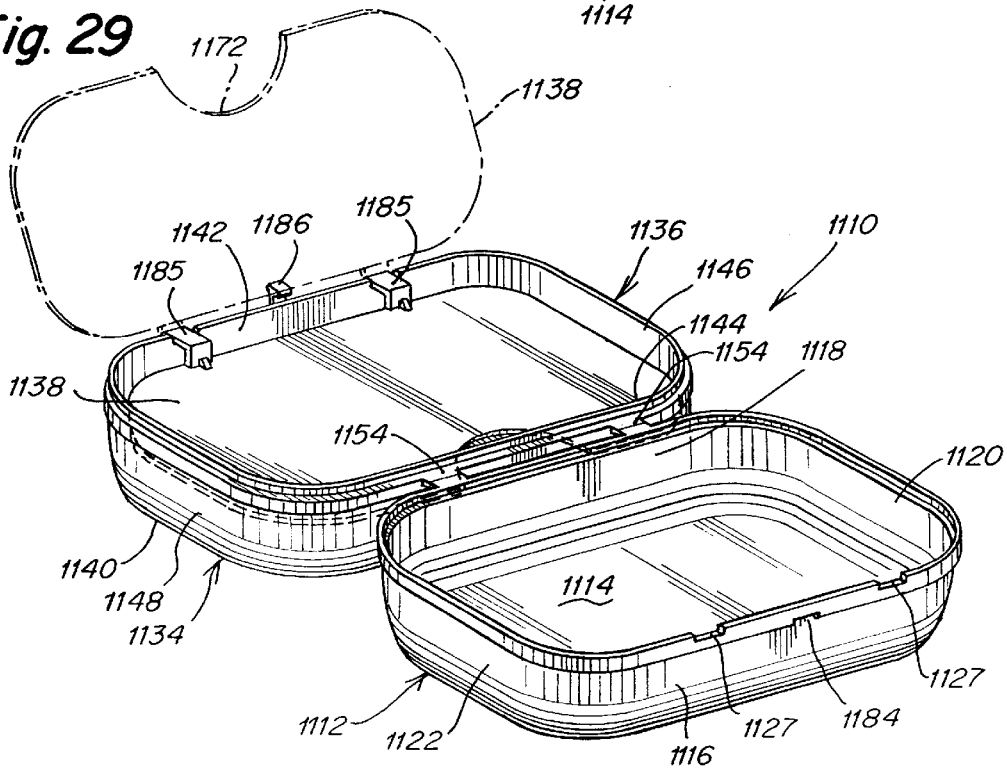
Figure 32:
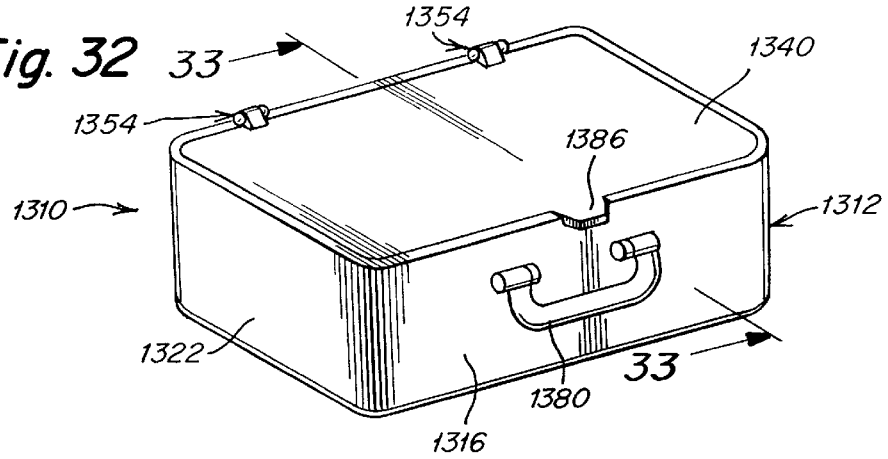
Figure 33:
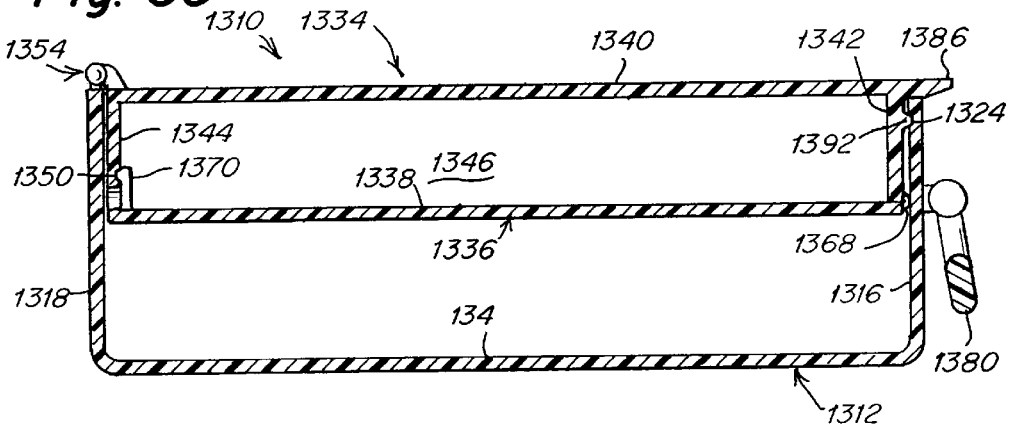
Figure 34:
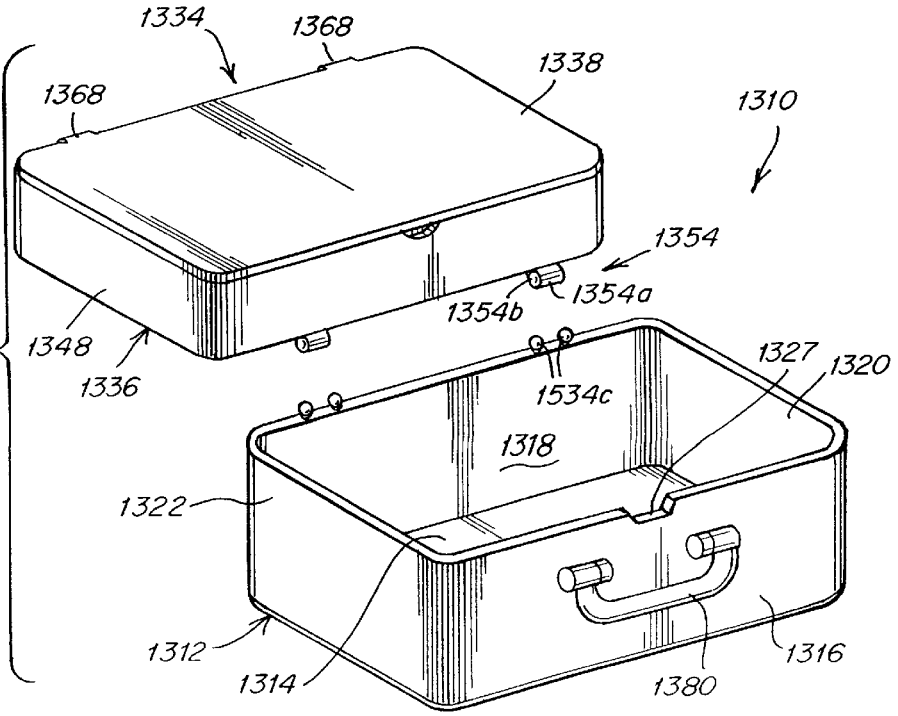
Figure 35:
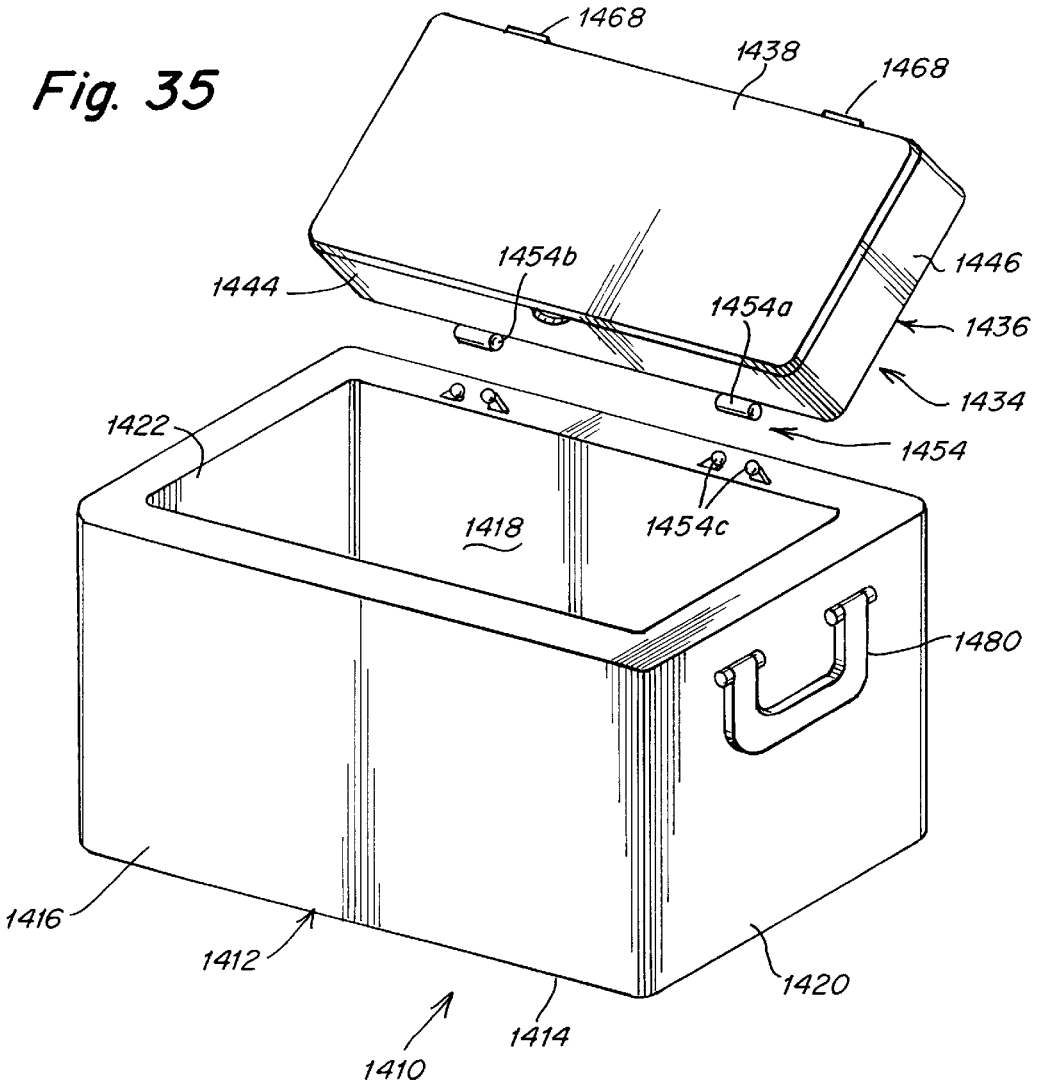

FIG. 17 a perspective view of a portable carrying and storage case according to a seventh embodiment of the present invention, in an open condition;

FIG. 18 is a perspective view of a portable carrying and storage case according to an eighth embodiment of the present invention, in a closed condition;

FIG. 19 is cross-sectional view of the portable carrying and storage case of FIG. 18, taken along line 19—19 thereof;

FIG. 20 is a perspective view of the portable carrying and storage case of FIG. 18 in an open condition;

FIG. 21 is a perspective view of a portable carrying and storage case according to a ninth embodiment of the present invention, i open condition;

FIG. 22 is a perspective view of a plurality of portable carrying and storage cases of FIG. 21, stacked on a shelf;

FIG. 23 a perspective view of a portable carrying and storage case according to a tenth embodiment of the present invention, in a closed condition;

FIG. 24 is a cross-sectional view of the portable carrying and storage case of FIG. 23, taken along line 24—24 thereof;

FIG. 25 is a perspective view of the portable carrying and storage case of FIG. 23 in a fully open condition;

FIG. 26 is a perspective view of a portable carrying and storage case according to an eleventh embodiment of the present invention, in an open condition;

FIG. 27 is a perspective view of a portable carrying and storage case according to a twelfth embodiment of the present invention, in closed condition;

FIG. 28 is a cross-sectional view of the portable carrying and storage case of FIG. 27, taken along line 28—28 thereof;

FIG. 29 is a perspective view of the portable carrying and storage case of FIG. 27 in a fully open condition;

FIG. 30 is a perspective view of a portable carrying and storage case according to a thirteenth embodiment of the present invention, in an open condition;

FIG. 31 is an exploded perspective view of a portable carrying and storage case of FIG. 30;

FIG. 32 is a perspective view of a portable carrying and storage case according to a fourteenth embodiment of the present invention, in a closed condition;

FIG. 33 is a cross-sectional view of the portable carrying and storage case of FIG. 32, taken along line 33—33 thereof;

FIG. 34 is a perspective view of the portable carrying and storage case of FIG. 32 in a partially open condition; and FIG. 35 is an exploded perspective view of a portable carrying and storage case according to a fifteenth embodiment of the present invention, in an open condition.

DETAILED DESCRIPTION

Referring to the drawings, and initially to FIGS. 1–4 thereof, a portable carrying and/or storage case 10 according to a first embodiment of the present invention is formed from a single mold and is made from any suitable plastic material, such as polypropylene or polyethylene which allow the living hinges (to be discussed hereinafter) to last from 50,000 to 100,000 openings on average, although other materials such as styrene, acrylic, metal, wood, etc. can be used. Although not repeated, all of the carrying and/or storage cases discussed hereinafter, can be made of the same material.

Portable carrying and/or storage case 10 includes a lower half shell 12 and an upper half shell or half shell cover 14. Lower half shell 12 is formed by a planar bottom wall 15 of a generally rectangular configuration and a front wall 16, rear wall 18 and side walls 20 and 22 surrounding bottom wall 15 and upstanding from bottom wall 15. The inner surface of rear wall 18 is provided with two spaced apart shallow recesses 24 at the same height. A first projecting ledge 26 is formed on the outer surface of front wall 16 at the upper edge thereof. In addition, a carrying projection 28 is formed on the outer surface of one side wall 20 and has an opening 30 through which a chain 32, a loop, or the like can be attached to carry or hang the portable carrying and/or storage case 10.

Upper half shell 14 is also formed by a planar wall 34 of substantially the same shape and dimensions as planar bottom wall 15, along with a front wall 36, rear wall 38 and side walls 40 and 42 surrounding planar wall 34 and upstanding from planar wall 34. Planar wall 34 is provided with a centrally located elongated tissue removal recess or slot 44. Front wall 16 and front wall 36 are connected together by two living hinges 46 at their upper edges. The rear wall 38 is provided with two hooks 48 adapted to engage with shallow recesses 24 in a snap fit relation in order to releasably maintain half shells 12 and 14 in a closed condition. A shallow finger recess 50 is formed in the outer, upper edge of rear wall 38 to allow a person to insert his or her nail therein, and thereby open upper half shell 14 by disengaging the hooks 48 from the respective recesses 24 and pivotally moving upper half shell 14 away from lower half shell 12, about living hinges 46.

Thus, lower and upper half shells 12 and 14 are adapted to hold wet or dry tissues, wipes or other similarly dispensable items 74 therein in a substantially hermetically sealed arrangement, with the tissues or the like being removable through elongated tissue removal recess in slot 44. Because half shells 12 and 14 can be opened and then closed shut again, new tissues can be inserted therein as needed.

Upper half shell 14 also includes two tabs 51 (see FIG. 3) on the outer surface of front wall 36 immediately inwardly of living hinges 46.

A cover 52 is formed by a planar wall 54 of the same general shape, but slightly larger in size, as bottom wall 15, along with a front wall 56, rear wall 58 and side walls 60 and 62 surrounding planar wall 54 and upstanding from wall 54. Rear wall 18 and rear wall 58 are connected together by two living hinges 64 at their upper edges. Front wall 56 is provided with two spaced apart recesses 66 extending down from the upper edge thereof. The inner surface of front wall 56 is also provided with two shallow recesses 68 immediately adjacent to and positioned inwardly of recesses 66. Upper lips 70 are provided at the upper edges of shallow recesses 68. A second projecting ledge 72 is formed on the outer surface of front wall 56 and is positioned immediately inwardly of one recess 68.

Figure 1:
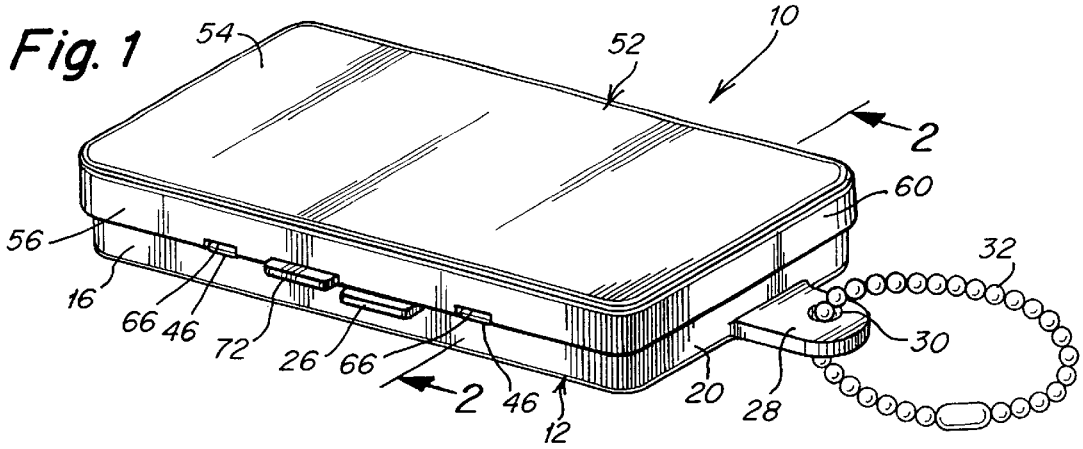
FIG. 1 is a perspective view of a portable carrying and storage case according to a first embodiment of the present invention, a closed condition.
Figure 2:
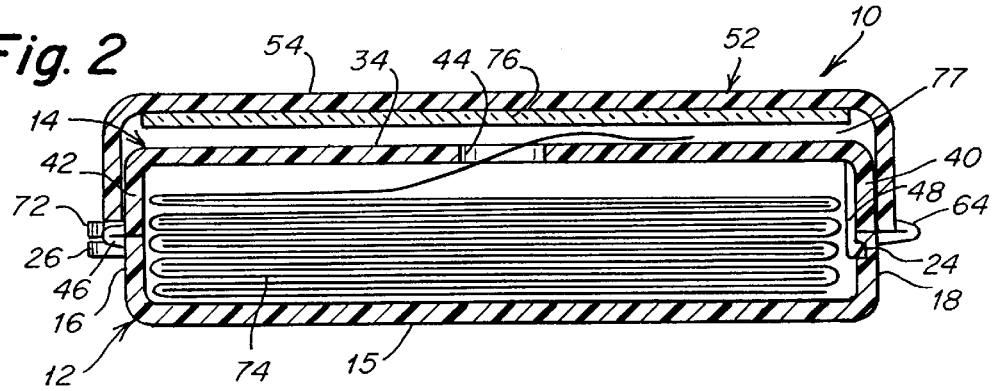
FIG. 2 is across-sectional view of the portable carrying and storage case of FIG. 1, taken along line 2—2 thereof.
Figure 3:
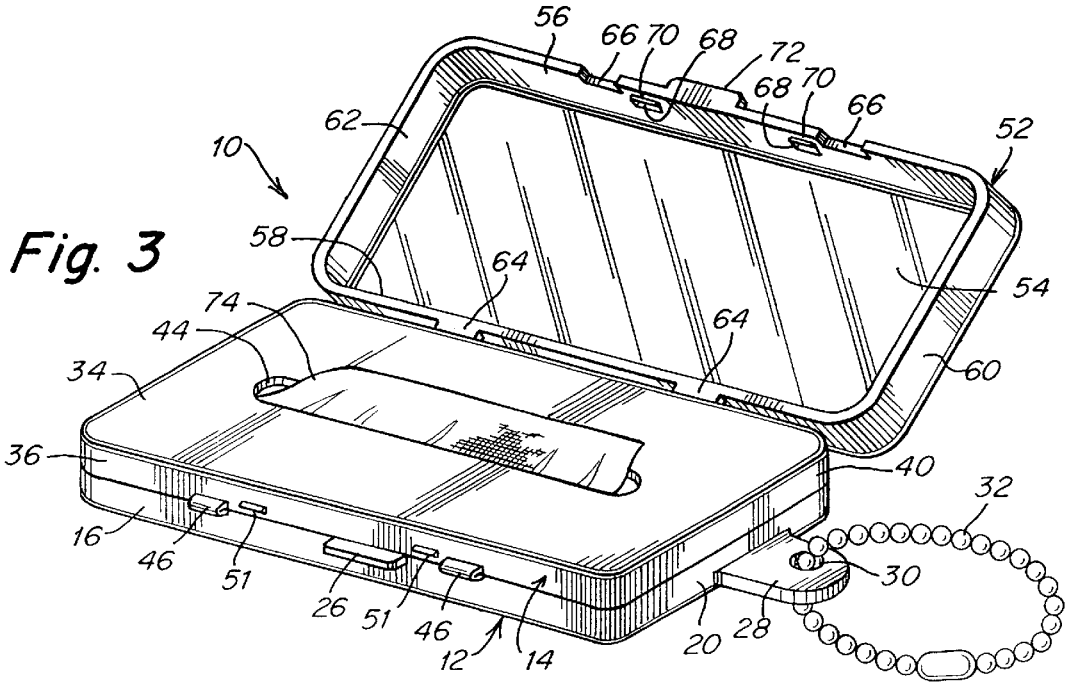
FIG. 3 is a perspective view of the portable carrying and storage case of FIG. 1 in a partially open condition.
Figure 4:
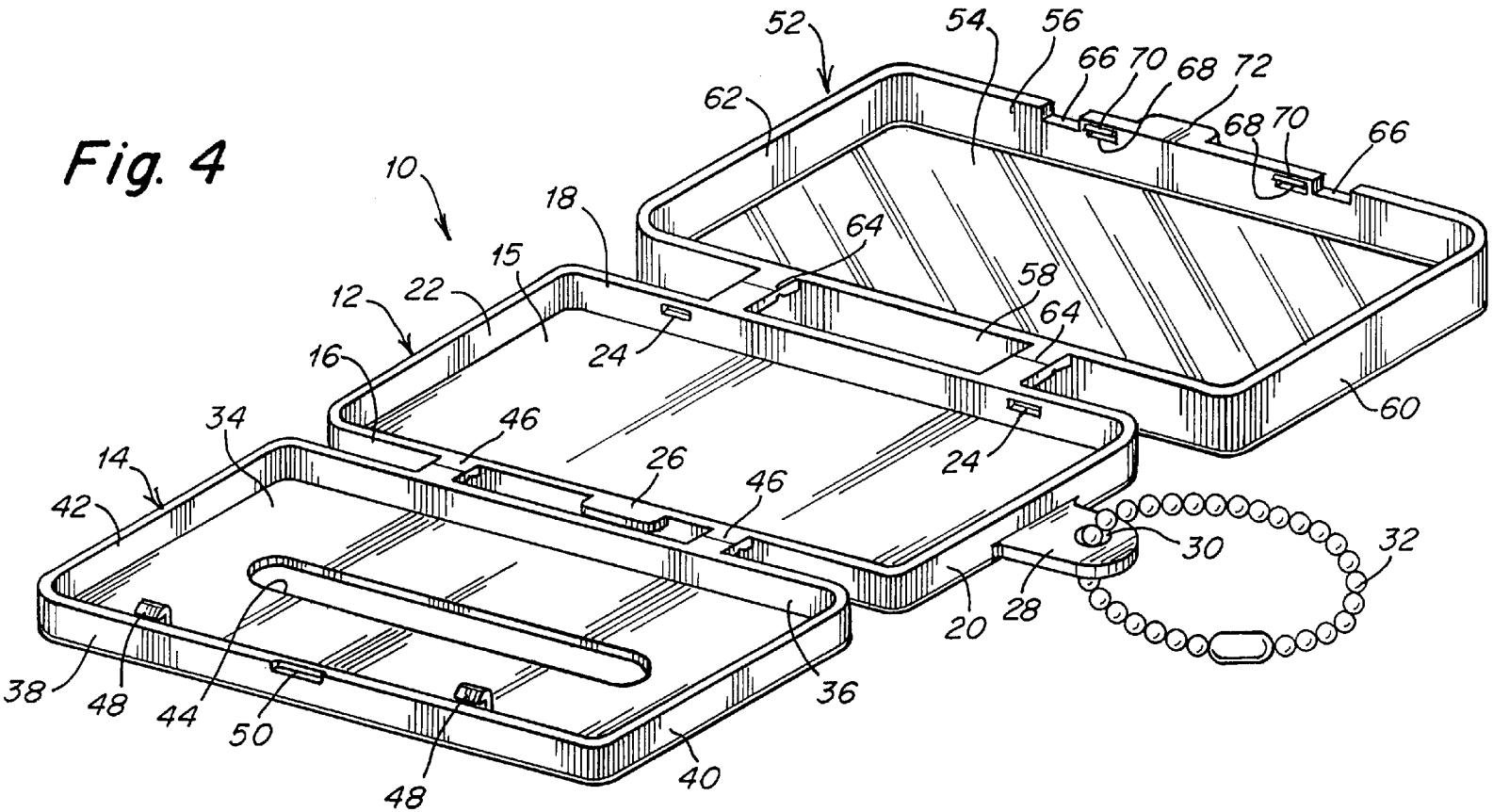
FIG. 4 is a perspective view of the portable carrying and storage case of FIG. 1 in a fully open condition.
Figure 5:
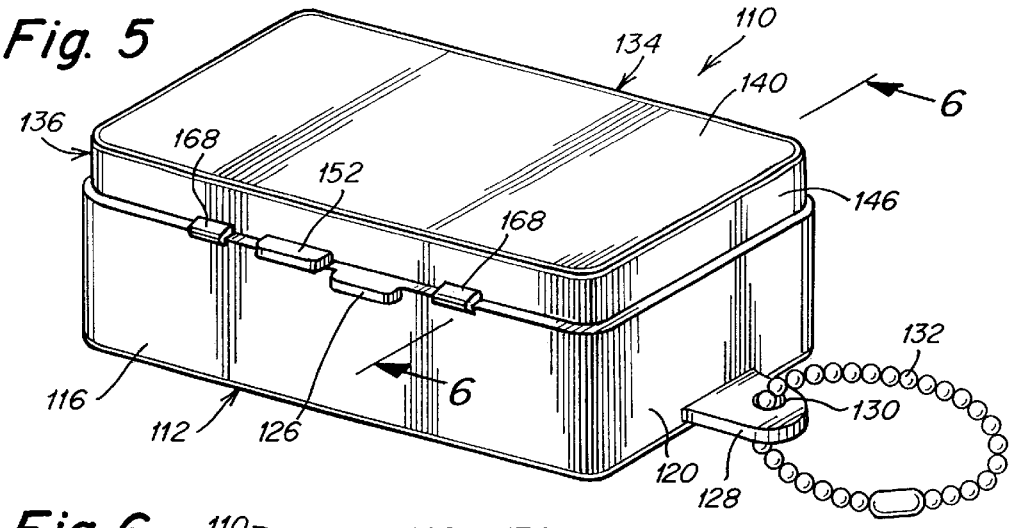
FIG. 5 is a perspective view of a portable carrying and storage case according to a second embodiment of the present invention, in a closed condition.
Figure 6:
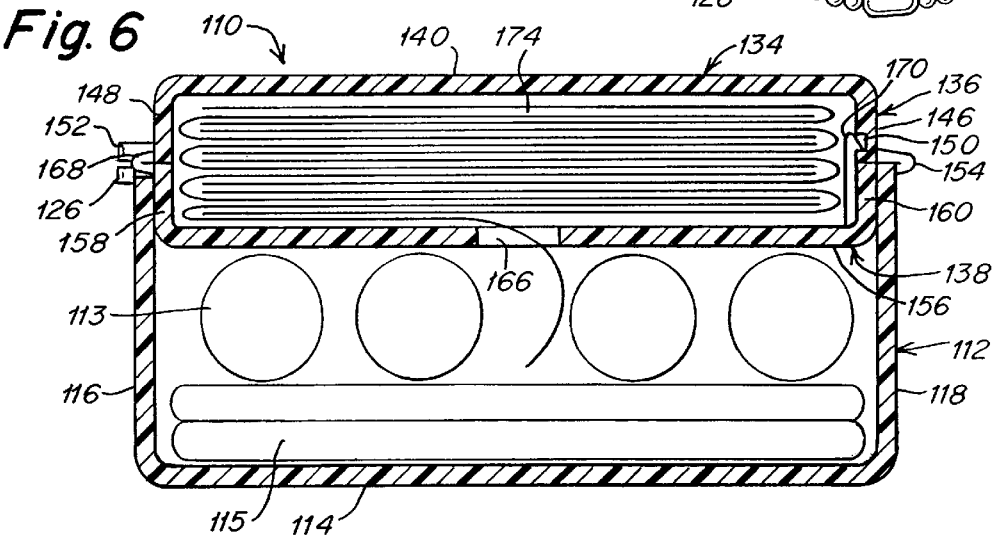
FIG. 6 is a cross-sectional view of the portable carrying and storage case of FIG. 5, taken along line 6—6 thereof.

When the cover 52 is pivoted about living hinges 64, front wall 56, rear wall 58 and side walls 60 and 62 snugly receive half shells 12 and 14 therein, while also providing a covering for elongated tissue removal recess 44, thereby forming a moisture tight closure to prevent the moist tissues from drying out. A compartment or space 77 is provided in the upper cover to accommodate additional items or articles, as desired. For example, a mirror 76 can be provided at the inner surface of planar wall 54, as shown in FIG. 2. In the closed condition, as shown in FIGS. 1 and 2, folded living hinges 46 are received in rectangular recesses 66, and tabs 51 releasably lock within shallow recesses 68. To open cover 52, and to disengage the locks, it is only necessary to move first and second projecting ledges 26 and 72 in opposite directions. Walls 56, 58, 60 and 62 can be made longer in the vertical direction in FIG. 2 to increase the size of the additional storage space 77, as seen in other embodiments.

Accordingly, with the first embodiment, wet or dry tissues 74 (or the like) can be stored and case 10 can be refilled with the same, while also providing an elongated tissue removal recess 44 and a cover 52 therefor, in a tri-part, dual-fold portable carrying and storage case 10. It will be appreciated, however, that other items can be held therein, such as baby wipes, tampons, mini-pads, eyeglass cleaning tissues, etc.

In the first embodiment of FIGS. 1–4, as well as in the later described embodiments, the connecting surfaces between the case and the cover parts may be made to meet relatively tightly so as to provide substantially water-tight storage compartments. This prevents moist wipes or other moist items from drying out.

In portable carrying and/or storage case 10, it will be appreciated that the parts can be considered in the reverse, that is, element 52 as a lower case section which defines a first compartment therein, elements 12 and 14 together as a cover for covering the first compartment, with element 12 defining a lower half shell forming a second compartment and element 14 defining a cover for the second compartment.

Referring now to FIGS. 5–8, a portable carrying and storage case 110 according to a second embodiment of the present invention is also a tri-part, dual-fold case, but the tissue carrying portion is provided as the cover.

The portable carrying and storage case 110 is formed from a single mold and is made from any suitable plastic material, such as polypropylene or polyethylene. Portable carrying and storage case 110 includes a deepened lower case section 112 formed by a planar bottom wall 114 of a generally rectangular configuration and a front wall 116, rear wall 118 and side walls 120 and 122 surrounding bottom wall 114 and upstanding from bottom wall 114. Lower case section 112 is of a sufficiently large size for holding items such as tampons 113, mini-pads 115, cosmetics, etc. Front wall 116 is provided with two spaced apart recesses 124 extending down from the upper edge thereof. Also, a first projecting ledge 126 is formed on the outer surface of front wall 116 at the upper edge thereof. In addition, a carrying projection 128 is formed on the outer surface of side wall 120 and has an opening 130 through which a chain 132 can be attached to carry or hang portable carrying and storage case 110.

A case cover 134 for the first compartment of lower case section 112 is formed by a lower half shell or first shell member 136 and an upper half shell or case cover member 138.

Lower half shell or first shell member 136 is formed by a planar wall 140 of a generally rectangular configuration and of similar shape but smaller dimensions than planar bottom wall 114, along with a front wall 142, rear wall 144 and side walls 146 and 148 surrounding bottom wall 140 and upstanding from wall 140. The inner surface of rear wall 144 is provided with two spaced apart shallow recesses 150 at the same height. Also, a second projecting ledge 152 is formed on the outer surface of front wall 142 at the upper edge thereof. Further, rear wall 118 and rear wall 144 are connected together by two living hinges 154 at their upper edges.

Upper half shell or case cover member 138 is also formed by a planar wall 156 of substantially the same shape and dimensions as planar wall 140, along with a front wall 158, rear wall 160 and side walls 162 and 164 surrounding planar wall 156 and upstanding from wall 156. Planar wall 156 is provided with a centrally located elongated tissue removal recess 166. Front wall 142 and front wall 158 are connected together by two living hinges 168 at their upper edges. The rear wall 160 is also provided with two hooks 170 adapted to engage with shallow recesses 150 in a snap fit relation in order to maintain half shells 136 and 138 in a releasably closed condition. A shallow finger recess 172 is formed in the outer, upper edge of rear wall 160 to allow a person to insert his or her nail therein, and thereby open upper half shell 138 by disengaging the hooks 170 from the respective recesses and pivotally moving upper half shell 138 away from lower half shell 136, about living hinges 168.

Figure 7:
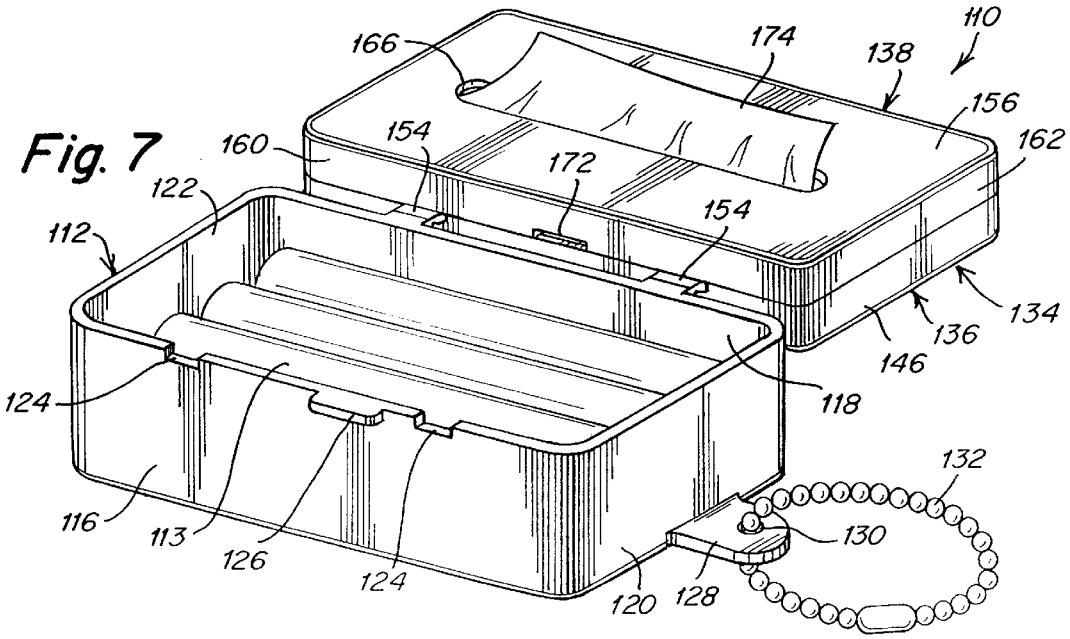
FIG. 7 is a perspective view of the portable carrying and storage case of FIG. 5 in a partially open condition.
Figure 8:
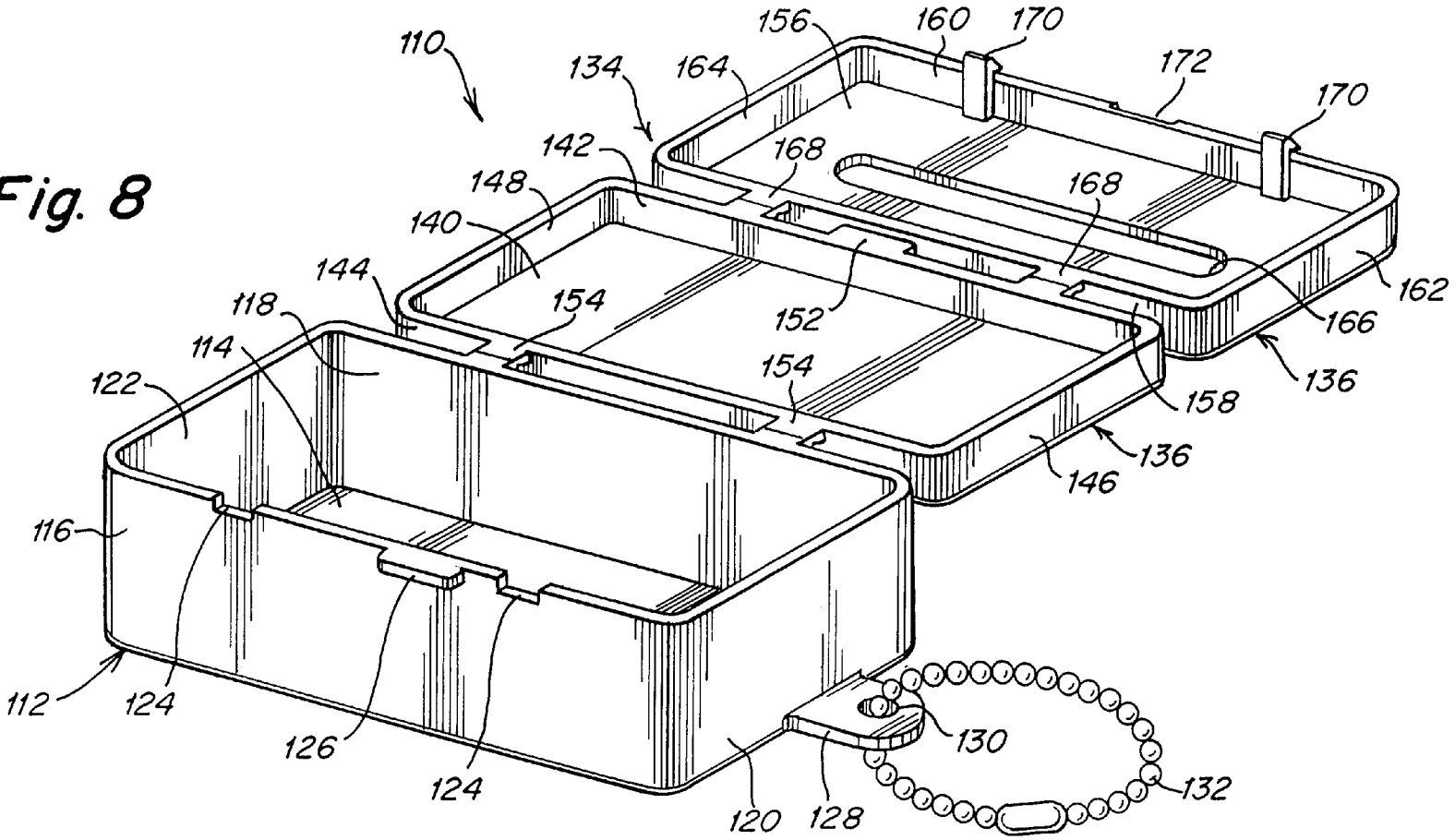
FIG. 8 is a perspective view of the portable carrying and storage case of FIG. 5 in a partially open condition.

Thus, lower and upper half shells 136 and 138 are adapted to hold dry tissues 174 therein, with the tissues being removable through elongated tissue removal recess 166, after case cover 134 has been pivoted to an open position about living hinges 154, to the position shown in FIG. 7. Because half shells 136 and 138 can be opened and then closed shut again, new tissues 174 can be inserted therein as needed. However, because elongated tissue removal recess 166 is oriented in a downward facing direction in the closed condition of case 110, wet tissues should preferably not be stored therein. However, if desired, wet tissues or the like can be stored in case cover 134.

When cover 134 is pivoted about living hinges 154 to a closed condition (see FIGS. 5 and 6), front wall 116, rear wall 118 and side walls 120 and 122 snugly receive half shells 136 and 138 therein, which provide a covering for the contents in lower case section 112. At this time, folded living hinges 168 are received in rectangular recesses 124. To open cover 134, it is only necessary to move first and second projecting ledges 126 and 152 in opposite directions.

Accordingly, with the second embodiment, dry (or dry) tissues or the like 174 can be stored and case 110 can be refilled with the same, while also providing an elongated tissue removal recess 166, and a lower case section 112 for storing additional items, in a tri-part, dual-fold portable carrying and storage case 110.

Figure 9:
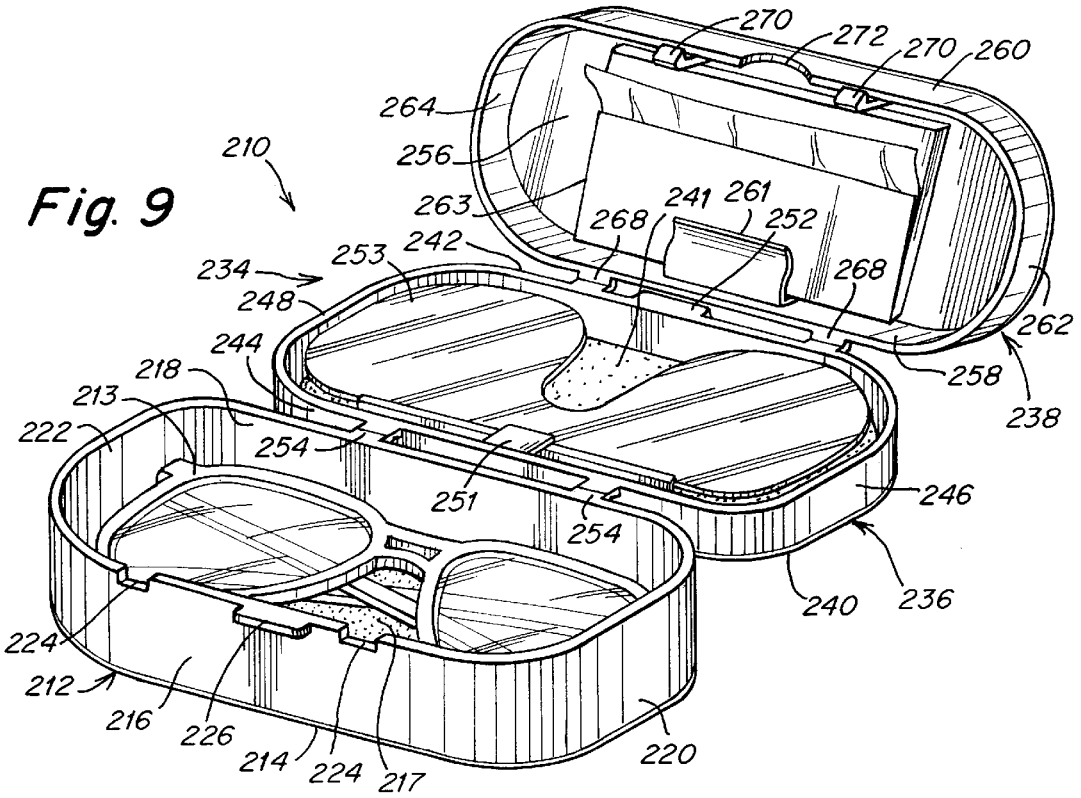
FIG. 9 is a perspective view of a portable carrying and storage case according to a third embodiment of the present invention, in an open condition.

Referring now to FIG. 9, a portable carrying and storage case 210 according to a third embodiment of the present invention is a tri-part, dual-fold case, similar to the embodiment of FIGS. 5—8. Accordingly, the same reference numerals will be used for like elements, but augmented by 100 to distinguish therefrom.

Portable carrying and storage case 210 includes a deepened lower case section 212 formed by a planar bottom wall 214 of a generally rectangular configuration with rounded corners, and a front wall 216, rear wall 218 and side walls 220 and 222 surrounding bottom wall 214 and upstanding from bottom wall 214. Lower case section 212 is of a sufficiently large size for holding items such as eyeglasses 213, etc, and can be provided with a foam bottom cushion 217. Front wall 216 is provided with two spaced apart rectangular recesses 224 extending down from the upper edge thereof. Also, a first projecting ledge 226 is formed on the outer surface of front wall 216 at the upper edge thereof.

A case cover 234 is formed by a lower half shell 236 and an upper half shell 238.

Lower half shell 236 is formed by a planar wall 240 of a generally rectangular configuration and of similar shape but smaller dimensions than planar bottom wall 214, and can be provided with a foam cushion 241. A front wall 242, rear wall 244 and side walls 246 and 248 surround bottom wall 240 and upstand from bottom wall 240. The inner surface of rear wall 244 is provided with two spaced apart shallow recesses (not shown) at the same height, and similar to shallow recesses 150 of the second embodiment. Also, a second projecting ledge 252 is formed on the outer surface of front wall 242 at the upper edge thereof. Further, rear wall 218 and rear wall 244 are connected together by two living hinges 254 at their upper edges. In addition, a clip 251 is formed to extend inwardly, centrally of the inner surface of rear wall 244, near the upper edge thereof for holding items such as clip-on shades 253 for eyeglasses 213.

Upper half shell 238 is also formed by a planar wall 256 of the same shape and dimensions as planar wall 240, along with a front wall 258, rear wall 260 and side walls 262 and 264 surrounding planar wall 256 and upstanding from wall 256. A clip 261 is formed to extend inwardly, centrally of the inner surface of front wall 258, near the upper edge thereof for holding items such as a box of tissues 263 or the like. Front wall 242 and front wall 258 are connected together by two living hinges 268 at their upper edges. The inner surface of rear wall 260 is also provided with two hooks 270 adapted to engage with the shallow recesses in rear wall 244 in a snap fit relation in order to maintain half shells 236 and 238 in a closed condition. A shallow finger recess 272 is formed in the outer, upper edge of rear wall 260 to allow a person to insert his or her nail therein, and thereby open upper half shell 238 by pivotally moving upper half shell 238 away from lower half shell 236, about living hinges 268.

Thus, lower and upper half shells 236 and 238 are adapted to hold a box of tissues 263 and clip-on shades 253 therein, which becomes accessible after cover 234 has been pivoted to an open position about living hinges 254. When cover 234 is pivoted about living hinges 254, front wall 216, rear wall 218 and side walls 220 and 222 snugly receive half shells 236 and 238 therein, which provide a covering for eyeglasses 213 held in lower case section 212. At this time, folded living hinges 268 are received in rectangular recesses 224. To open cover 234, it is only necessary to move the first and second projecting ledges 226 and 252 in opposite directions.

Figure 10:
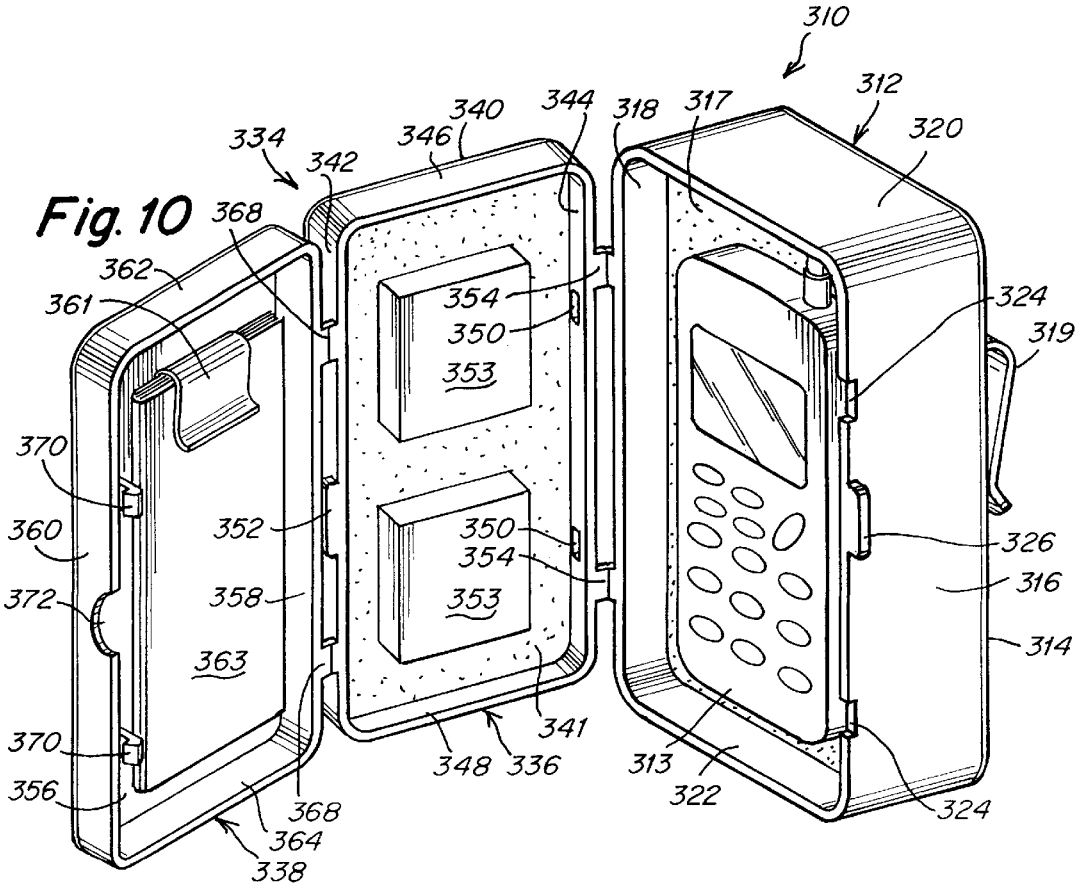
FIG. 10 is a perspective view of a portable carrying and storage case according to a fourth embodiment of the present invention, in an open condition.
Figure 11:
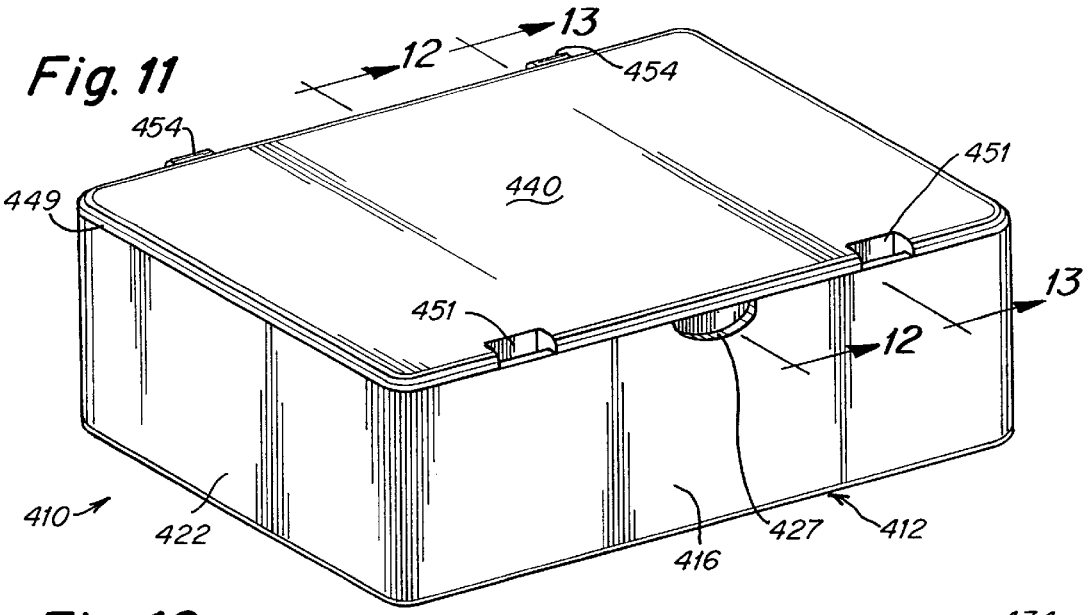
FIG. 11 is a perspective view of a portable carrying and storage case according to a fifth embodiment of the present invention, in a closed condition.
Figure 12:
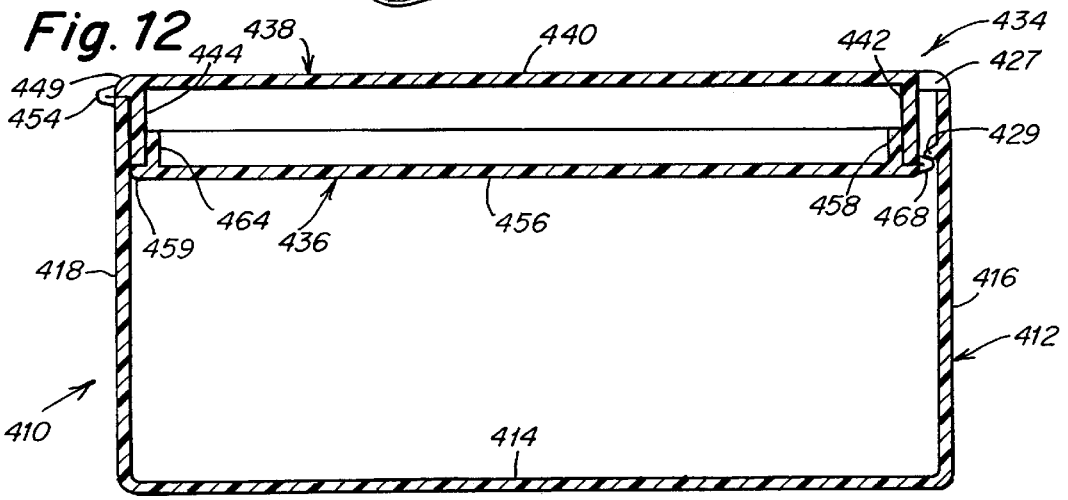
FIG. 12 is a cross-sectional view of the portable carrying and storage case of FIG. 11, taken along line 12—12 thereof.
Figure 13:
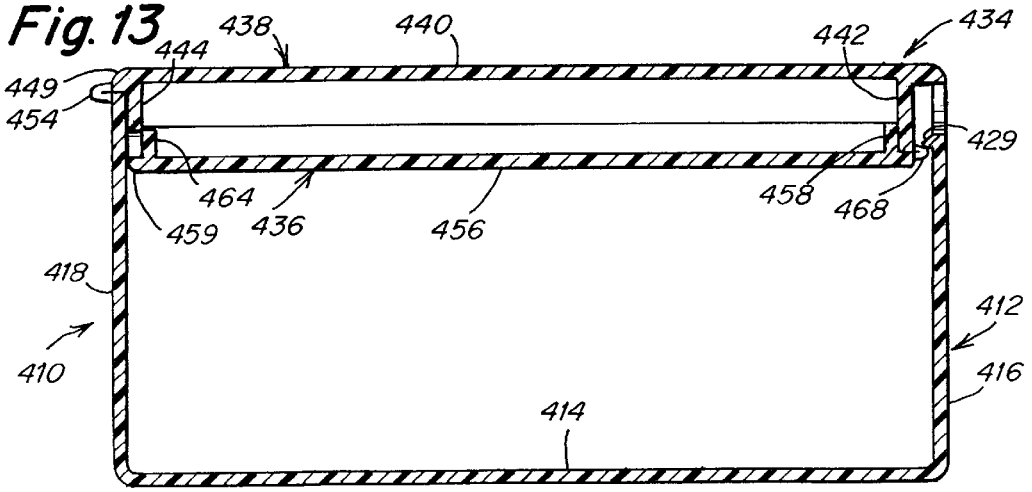
FIG. 13 is a cross-sectional view of the portable carrying and storage case of FIG. 11, taken along line 13—13 thereof.
Figure 14:
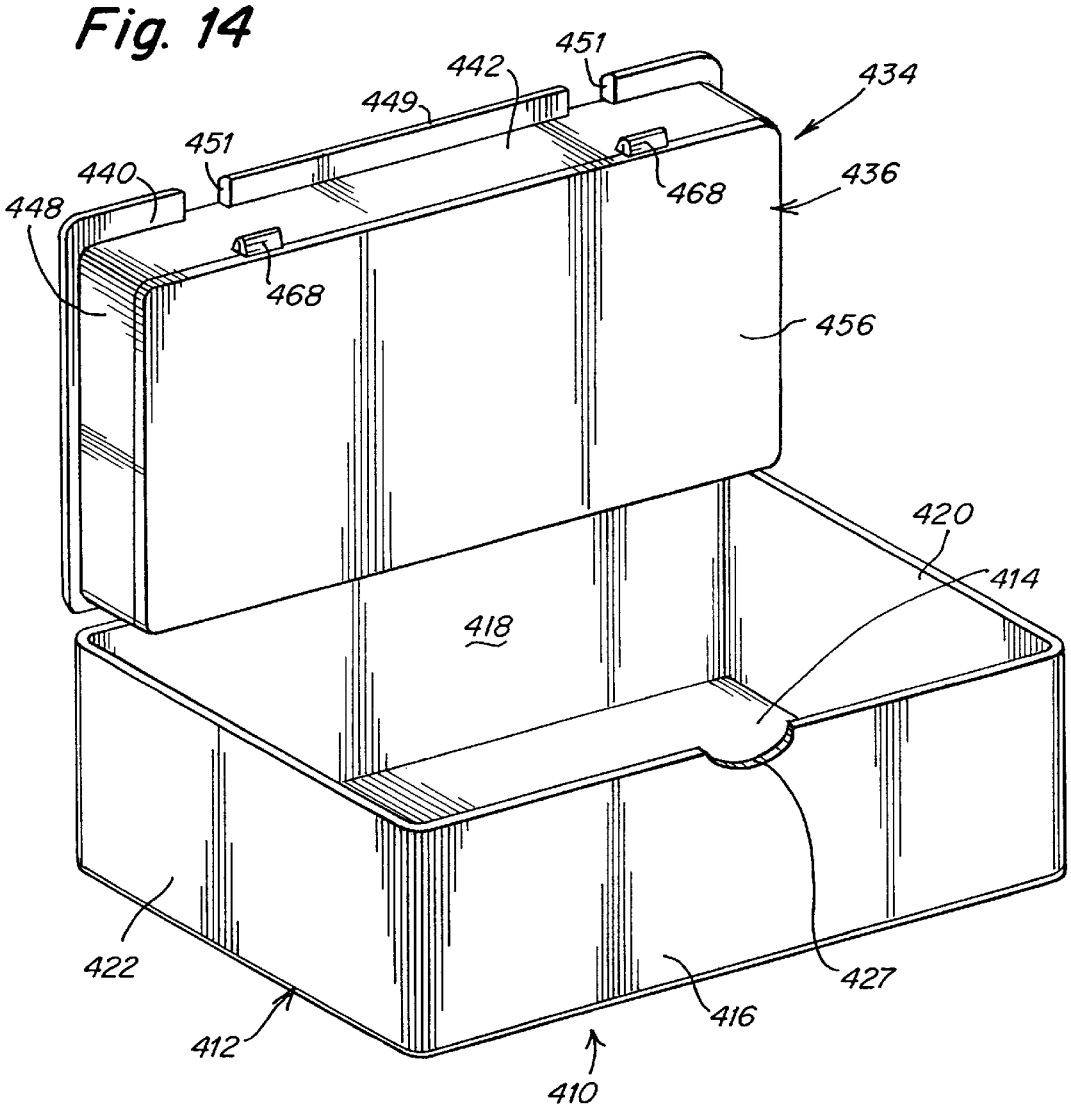
FIG. 14 is a perspective view of the portable carrying and storage case of FIG. 11 in a partially open condition.

The portable carrying and storage case 310 of the fourth embodiment of FIG. 10 is similar to the portable carrying and storage case 210 of the third embodiment of FIG. 9, and accordingly, the same elements are referenced by the same numerals, but augmented by 100, and a detailed discussion of these common elements is thereby omitted. Therefore, only the differences will be discussed.

In portable carrying and storage case 310, a portable cellular telephone 313, battery charger or the like is held in lower case section 312 instead of eyeglasses 213. Also, the underside or rear side of planar bottom wall 314 is provided with a belt clip 319 by which the portable carrying and storage case 310 can be clipped to a person's belt.

Also, for example, spare batteries 353 for cellular telephone 313 are held in lower half shell 336. Further, shallow recesses 350 are shown in the inner surface of rear wall 344 which engage hooks 370 when the shell 338 is closed on the shell 334.

With respect to upper half shell 338, clip 361 is positioned adjacent side wall 362, and instead of holding a box of tissues, clip 361 can hold other items, such as, for example, the shown checkbook or notebook or diary 363.

The portable carrying and storage case 410 of the fifth embodiment of FIGS. 11–15 is substantially the same as the portable carrying and storage case 210 of the third embodiment of FIG. 9, and accordingly, the same elements are referenced by the same numerals, but augmented by 200, and a detailed discussion of these common elements is thereby omitted. Therefore, only the differences will be discussed.

Figure 15:
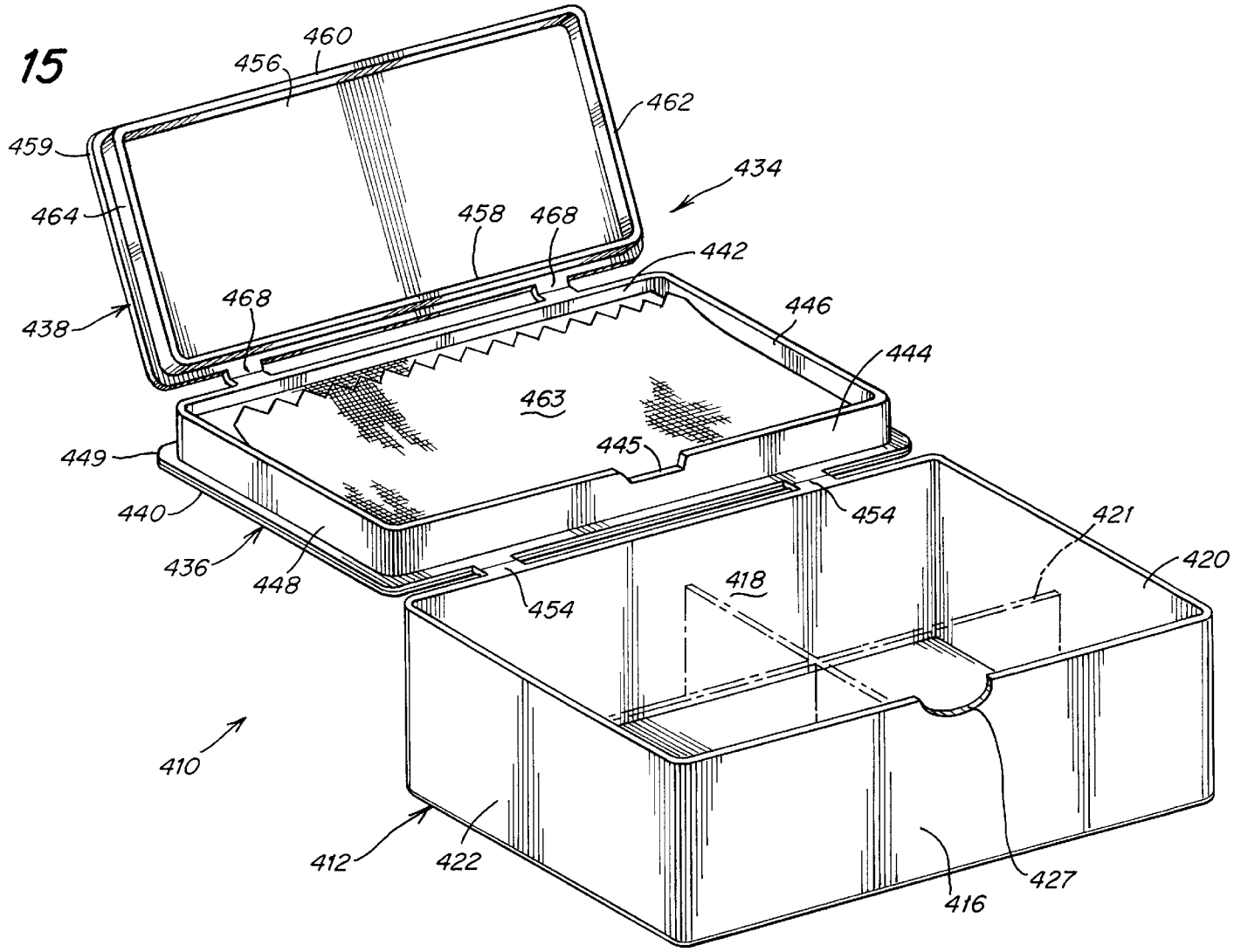
FIG. 15 is a perspective view of the portable carrying and storage case of FIG. 11 in a fully open condition.

Portable carrying and storage case 410 stores moist tissues or other moist items, but does not include a tissue removal recess. In this regard, portable carrying and storage case 410 is particularly applicable for storing baby items. Thus, lower case section 412 is very deep and is adapted to store baby diapers, powders, changing pads, ointments, etc. Alternatively, as shown in FIG. 15, a cross-shaped partition 421 can be provided in lower case section 412 for separating lower case section 412 into four smaller compartments. Also, rectangular recesses 224 and first projecting ledge 226 are eliminated. Instead, a shallow finger recess 427 is provided in the upper edge of front wall 416. Further, tabs 429 (see FIGS. 12 and 13) are formed on the inner surface of front wall 416 immediately below the upper edge thereof, for engaging with folded living hinges 468 in order to maintain (i.e., lock) cover 434 in a closed condition.

As to lower half shell 436, second projecting ledge 252 and the shallow recesses are eliminated. Further, front wall 442, rear wall 444 and side walls 446 and 448 are positioned slightly inwardly from the peripheral edge of planar bottom wall 440 so as to define an outer peripheral ledge 449 adapted to rest on top of the upper edges of front wall 416, rear wall 418 and side walls 420 and 422 of compartment 412. Two recesses 451 are formed in the front of outer peripheral ledge 449 for molding purposes. Also, a shallow finger recess 445 (see FIG. 15) is provided centrally at the upper edge of rear wall 444. Wet or moist tissues 463, such as baby wipes, can be held on planar bottom wall 440 of compartment 436.

As to upper half shell or half shell cover 438, recess 272 and hooks 270 are eliminated. Further, front wall 458, rear wall 460 and side walls 462 and 464 are positioned slightly inwardly from the peripheral edge of planar bottom wall 456 so as to define an outer peripheral ledge 459 (FIG. 15) adapted to rest on top of the upper edges of front wall 442, rear wall 444 and side walls 446 and 448, with front wall 458, rear wall 460 and side walls 462 and 464 snugly fitting in a friction fit with front wall 442, rear wall 444 and side walls 446 and 448.

Thus, after wet tissues 463 or the like are positioned on planar bottom wall 440 of lower half shell 436, upper half shell 438 is pivoted about living hinges 468 such that front wall 458, rear wall 460 and side walls 462 and 464 snugly fit in a friction fit with front wall 442, rear wall 444 and side walls 446 and 448. Then, case cover 434 is pivoted about living hinges 454 to close case cover 434 such that peripheral ledge 449 rests on the upper edges of front 416, rear wall 418 and side walls 420 and 422. Preferably, front wall 442, rear wall 444 and side walls 446 and 448 also snugly fit in a friction fit with front wall 416, rear wall 418 and side walls 420 and 422.

To open the same, a person slips a finger in recess 427 to open case cover 434 about living hinges 454 and provide access to the contents of lower case section 412. Then, upper half shell 438 can be pivoted about living hinges 454 by inserting a finger in finger recess 445 to provide access to wet tissues 463 or the like.

Figure 16:
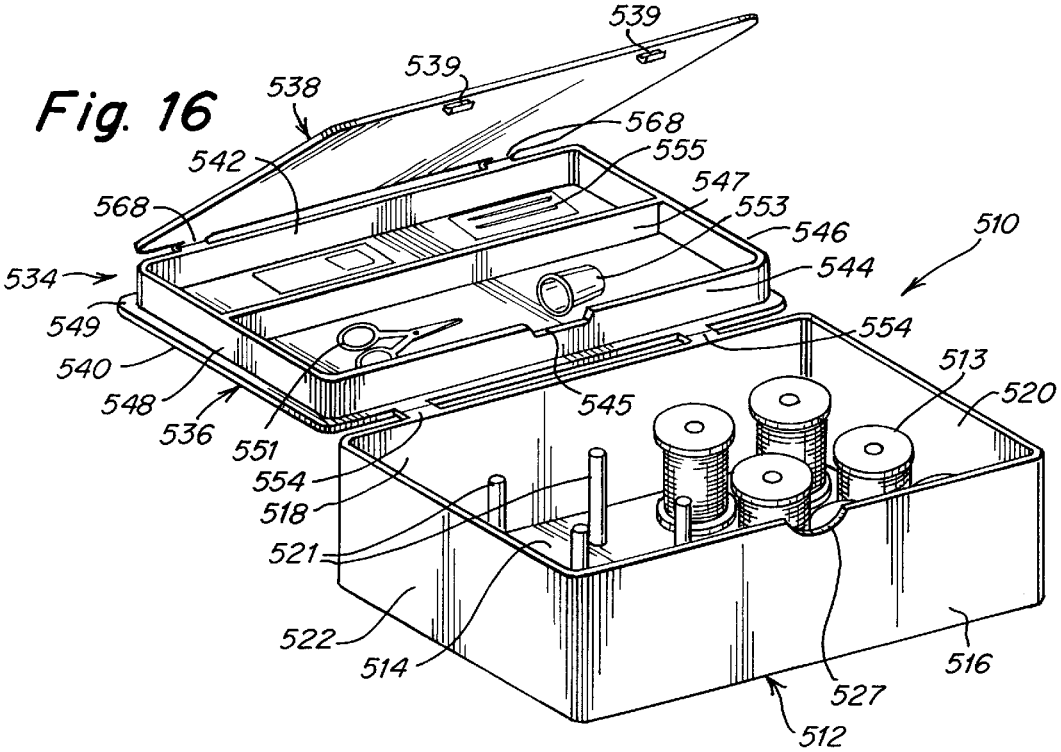
FIG. 16 is a perspective view of a portable carrying and storage case according to a sixth embodiment of the present invention, in an open condition.

The portable carrying and storage case 510 of the sixth embodiment of FIG. 16 is similar to the portable carrying and storage case 410 of the fifth embodiment of FIGS. 11–15, and accordingly, the same elements are referenced by the same numerals, but augmented by 100, and a detailed discussion of these common elements is thereby omitted. Therefore, only the differences will be discussed.

In lower case section 512, there are a plurality of posts 521 upstanding from planar bottom wall 514, for holding a plurality of thread spools 513 thereon.

Further, lower half shell 536 has a partition 547 to divide the same into compartments. Partition 547 can divide lower half shell 536 into two or more compartments, as desired, depending upon the configuration of partition 547. Thus, scissors 551, a thimble 553, needles 555, etc. can be held in the different compartments.

Upper half shell 438 of FIG. 15 is replaced with a planar half shell cover 538 that is hinged to the upper edge of front wall 542 and which overlies the upper edges of front wall 542, rear wall 544 and side walls 546 and 548 in the closed condition thereof. Since there is no friction fit as in the embodiment of FIGS. 11–15, the underside of planar half shell cover 538 is provided with two hooks 539 adjacent the rear edge thereof, for engagement with two shallow recesses (not shown) at the inner surface of rear wall 544 of lower half shell 536.

Thus, portable carrying and storage case 510 is adapted to form a portable sewing case or basket in a tri-part, dual-fold arrangement.

The portable carrying and storage case 610 of the seventh embodiment of FIG. 17 is similar to the portable carrying and storage case 510 of the sixth embodiment of FIG. 16, and accordingly, the same elements are referenced by the same numerals, but augmented by 100, and a detailed discussion of these common elements is thereby omitted. Therefore, only the differences will be discussed.

In the embodiment of FIG. 17, there are eight compartments, rather than two compartments, in lower half shell 636, which are separated by dividing walls 647. Also, posts 521 are eliminated. Half height corner posts 621 are provided for supporting a drop in tray 623 therein, so as to effectively divide lower case section 612 into upper and lower compartments.

Portable carrying and storage case 610 can be used as a jewelry case for holding jewelry items, such as bracelets, necklaces and watches in lower case section 612 and other items such as rings, earrings, etc. in the smaller compartments in cover 634, although it can have other uses, such as for cosmetics, etc. The drop in tray can also be provided with partitions or dividers, such as partitions 647, to better separate and store the contents.

The portable carrying and storage case 710 of the eighth embodiment of FIGS. 18–20 is similar to the portable carrying and storage case 510 of the sixth embodiment of FIG. 16, and accordingly, the same elements are referenced by the same numerals, but augmented by 200, and a detailed discussion of these common elements is thereby omitted. Therefore, only the differences will be discussed.

Portable carrying and storage case 710 of FIGS. 18–20 is particularly adapted for holding pencils, pens, markers, erasers and other stationery items. Thus, lower case section 712 can be made shallower than lower case section 412. Further, lower half shell 736 is divided by two partitions. Also, outer peripheral ledge 449 is eliminated, and instead, half shell cover 738 has an outer peripheral dimension to fit with a friction fit with the inner surfaces of front wall 716, rear wall 718 and side walls 720 and 722, as shown in FIG. 19. Still further, rather than two discrete living hinges 554 and two discrete living hinges 568, a single elongated living hinge 754 and a single elongated living hinge 768 are provided, each extending over substantially the entire length (or a major portion of the length) of portable carrying and storage case 710.

As a further modification, half shell cover 738 is formed with a downwardly extending projection 739 of the same shape and size as shallow finger recess 745 so as to fit therein, with projection 739 including ribs 741 on the outer surface thereof to be engaged by the user's finger when opening half shell cover 738. In like manner, the outer surface of front wall 742 is provided with ribs 743 at the position exposed by recess 727 to aid a user in opening half shell cover 738.

The portable carrying and storage case 810 of the ninth embodiment of FIGS. 21 and 22 is substantially identical to the portable carrying and storage case 510 of the sixth embodiment of FIG. 16, and accordingly, the same elements are referenced by the same numerals, but augmented by 300, and a detailed discussion of these common elements is thereby omitted. Therefore, only the differences will be discussed.

Thread spools 513 and posts 521 are eliminated, and lower case section 812 is made shallower than lower case section 512. Lower case section 812 is particularly adapted to hold file folders 813, papers, or the like in a flat condition. Also, outer peripheral ledge 549 is eliminated. The partition 847 separates lower half shell 836 into six smaller compartments, although this number can vary. The smaller compartments are particularly adapted to carry computer disks 853, cassettes, etc. After file folders 813 and computer disks 853 are stored in portable carrying and storage case 810, a plurality of the portable carrying and storage cases 810 can be stored on a shelf 469 for easy retrieval, as shown in FIG. 22, and labels 860 can be applied.

The partition member 847 is slideably mounted in the case section 834 via channel defining projections 870 which frictionally engage free edges of partition member 847. Thus, the partition member 847 can be replaced to provide different compartment configurations in case section 834.

The portable carrying and storage case 910 of the tenth embodiment of FIGS. 23–25 is similar to the portable carrying and storage case 810 of the ninth embodiment of FIGS. 21 and 22, and accordingly, the same elements are referenced by the same numerals, but augmented by 100, and a detailed discussion of these common elements is thereby omitted. Therefore, only the differences will be discussed.

With portable carrying and storage case 910, there are two covers 934, hinged by living hinges 954 at opposite side walls 920 and 922, respectively, instead of rear wall 918. Thus, each cover 934 is of a size equal to about one-half of the size of lower case section 912. The lower half shell 936 of each case cover 934 is divided by partition 947 into only two compartments. Also, shallow recesses 924 are provided on the inner surfaces of front wall 916 and rear wall 918, and tabs 949 are provided in side walls 946 and 948 for releasably engaging within shallow recesses 924. Also, larger tabs 951 are provided in side walls 946 which are in alignment with recess 927 in the closed condition, and by which a person can open case covers 934. In addition, partitions 947 can be made removable as described above with respect to partition member 847. Because of tolerances, living hinges 968 of the two case covers 934 snap together to hold case covers 934 in position.

The compartments 934 are particularly adapted to carry computer disks, cassettes, etc, while lower case section 512 is particularly adapted to carry file folders, papers, etc. The compartments 934 can be divided into other configurations, as desired.

The portable carrying and storage case of FIGS. 23–25 is a five-part, four-fold case.

The portable carrying and storage case 1010 of the eleventh embodiment of FIG. 26 is similar to the portable carrying and storage case 510 of the sixth embodiment of FIG. 16, and accordingly, the same elements are referenced by the same numerals, but augmented by 500, and a detailed discussion of these common elements is thereby omitted. Therefore, only the differences will be discussed.

Portable carrying and storage case 1010 is particularly adapted to be used as an attache case. In order to prevent inadvertent breakage of living hinges 1054 and to limit the extent that cover 1034 can be opened relative to lower case section 1012, hinged metal or plastic restraining hinge bars 1076 are connected between side walls 1020 and 1046, and between side walls 1022 and 1048.

Also, as with conventional attache cases, an accordion style file section 1078 is provided in lower half shell 1036. Above accordion style file section 1078, there are provided partitions 1047 for dividing the small area thereat into compartments. In order to prevent small items which are held in the compartments from escaping therefrom, half shell cover 1038 is made smaller to only cover the compartments. Lastly, a handle 1080 is attached to the outer surface of front wall 1016.

It will be appreciated that hooks 539, shallow finger recess 545 and outer peripheral ledge 549 are eliminated in this embodiment. Further, any suitable arrangement, such as a latch, etc. can be provided for releasably locking case cover 1034 with lower case section 1012, since case cover 1034 does not fit within lower case section 1012, as in the other embodiments. The bars 1076 can be replaced with flexible restraining straps.

The portable carrying and storage case 1110 of the twelfth embodiment of FIGS. 27–29 is substantially similar to the portable carrying and storage case 1010 of the eleventh embodiment of FIG. 26, and accordingly, the same elements are referenced by the same numerals, but augmented by 100, and a detailed discussion of these common elements is thereby omitted. Therefore, only the differences will be discussed.

Portable carrying and storage case 1110 does not include hinged restraining bars 1076, accordion style file section 1078 or handle 1080.

Further, half shell cover 1138 covers the entire lower half shell 1136, except for a center portion at the rear edge thereof which is provided with a small arcuate recess 1172.

However, half shell cover 1138 is not hinged to lower half shell 1136, and accordingly, living hinges 1154 are eliminated. Rather, two stop tabs 1183 are formed in the inner surface of rear wall 1144 and two L-shaped members 1185 are slidably or fixedly mounted through front wall 1142. The upper edges of L-shaped members 1185 may be in the same plane as the upper edges of stop tabs 1183 in the closed condition of portable carrying and storage case 1110. In this regard, the single recess 1027 is eliminated and replaced by two smaller recesses 1127 in the upper edge of front wall 1116 to receive the L-shaped members 1185. Thus, in the fully opened condition of portable carrying and storage case 1110, half shell cover 1138 is positioned on top of the contents in lower half shell 1136 and is held down by tabs 1183 and L-shaped members 1185.

In addition, as shown in FIG. 28, in order to releasably lock cover 1134 to lower case section 1112, a downwardly extending member 1184 is formed in front wall 1116 and a hook 1186 is formed on the outer surface of front wall 1142 for releasably engaging the member 1184.

The portable carrying and storage case 1110 of FIGS. 27–29 is particularly adapted to hold a freezable liquid package in compartment 1134, which is held down by half shell cover 1138, for keeping fruit and drinks cool in the other compartment 1112, for at least a several hour period.

Alternatively, it can be used as a package for a retail product. For example, a silverware or cutlery organizer can be provided in one compartment in molded form for spoons, forks, knives, etc. Thus, the silverware is maintained together in a neat and compact arrangement, without the use of a conventional drop-out tray.

The portable carrying and storage case 1210 of the thirteenth embodiment of FIGS. 30 and 31 is substantially similar to the portable carrying and storage case 510 of the sixth embodiment of FIG. 16, and accordingly, the same elements are referenced by the same numerals, but augmented by 700, and a detailed discussion of these common elements is thereby omitted. Therefore, only the differences will be discussed.

Portable carrying and storage case 1210 is particularly adapted to carry paper, pads, paint tubes, palette, paint trays, and other supplies, etc. for an artist.

As to lower case section 1212, the spools 513, posts 521 and recess 527 have been eliminated. In addition, a handle 1280 has been provided at the outer surface of front wall 1216, along with a latch 1284 near the upper edge of front wall 1216.

In lower half shell 1236, shallow finger recess 545, partition 547 and peripheral ledge 549 are eliminated. Further, living hinges 554 are eliminated and replaced with detachable hinges 1254. In this regard, detachable hinges 1254 include two female cylindrical elements 1254*a* on the outer surface of rear wall 1244 near the upper edge thereof, with outer ends of cylindrical elements 1254*a* including part-spherical recesses 1254*b*. Two male cylindrical elements 1254*c* are formed on the outer surface of rear wall 1218 near the upper edge thereof and include two part-spherical detents 1254*d* at the inner facing ends thereof, for removable insertion in part-spherical recesses 1254*b* in order to pivotally connect cover 1234 to lower case section 1212. Therefore, case cover 1234 can be removed for extra convenience.

A paint tray 1288 can be mounted, permanently or removably, within a portion of lower half shell 1236. The other portion of lower half shell 1236 is adapted to hold paint brushes, water color packets, etc. A hook 1286 is also provided on the outer surface of front wall 1242 for releasably engaging latch 1284.

Half shell cover 1238 is shaped as an artist's palette, and has finger receiving hole 1270 and a hand-receiving recess 1271. Therefore, hooks 539 are eliminated.

Also, living hinges 568 are eliminated and replaced with detachable hinges 1268. In this regard, detachable hinges 1268 include two recesses 1268*a* on the free edge of front wall 1242, with opposite facing ends of recesses 1268*a* including part-spherical recesses 1268*b*. Two sets of two male arms 1268*c* are formed at the rear edge of half shell cover 1238 and each arm 1268*c* includes a part-spherical detent 1268*d* at the outer facing end thereof, for removable insertion in part-spherical recesses 1268*b* in order to pivotally connect half shell cover 1238 to lower half shell 2136 in a removable manner. Therefore, half shell cover 1238 can be removed for extra convenience, for example, for mixing water colors, acrylics, oils, etc., or for serving as a palette. Also, this provides that the palette can washed afterwards. Other detachable hinge structure could be used, as should be readily apparent, and the detachable hinge between case 1212 and cover 1234 can be replaced with a living hinge.

The portable carrying and storage case 1310 of the fourteenth embodiment of FIGS. 32–34 is substantially similar to the portable carrying and storage case 1210 of the thirteenth embodiment of FIGS. 30 and 31, and accordingly, the same elements are referenced by the same numerals, but augmented by 100, and a detailed discussion of these common elements is thereby omitted. Therefore, only the differences will be discussed.

In portable carrying and storage case 1310, male cylindrical elements 1254*c* are replaced by two pair of spherical balls 1354*c* at the upper edge of rear wall 1318, and latch 1284 is replaced with a shallow recess 1327 at the center, upper edge of front wall 1316. Also, shallow recesses 1324 are provided in the inner surface of front wall 1316.

Further, lower half shell 1336 is formed with a finger projection 1386 centrally at the lower edge of front wall 1342 which rests within shallow recess 1327 of lower case section 1312 in the closed position, as shown in FIGS. 32 and 33. Also, the outer surface of front wall 1342 is formed with detents or projections 1392 which engage with shallow recesses 1324 in the inner surface of the front wall of lower case section 1312 to releasably engage cover 1334 in the closed condition of FIG. 33.

Other detachable hinge configurations could be used, as should be apparent.

Further, as shown in FIG. 34, living hinges 1368 are used in place of detachable hinges 1268. In order to retain half shell cover 1338 in a closed condition, the inner surface of rear wall 1344 of lower half shell 1336 is formed with recesses 1350, and half shell cover 1338 is provided with hooks 1370 for releasably engaging within recesses 1350.

Portable carrying and storage case 1310 can be used for varied purposes. For example, one compartment can hold sandwiches and the other compartment can hold fruit and drinks. Alternatively, different foods can be held in each compartment, for example, tuna in one compartment and salami in the other compartment, while sitting for three to four hours in a school. The compartments can also be double insulated for maintaining foods in a fresh state. Thus, portable carrying and storage case 1310 can be used as a lunch box or picnic carrier.

As an alternative, portable carrying and storage case 1310 can be used for dishware, such as forks, spoons, napkins and a table cloth in one compartment, and cups, saucers, plates, etc. in the other compartment.

As another alternative, portable carrying and storage case 1310 can be used for holding clothing, such as shirts, pants, etc. in lower case section 1312, and underwear, socks, etc. in cover 1334. Any other suitably sized articles can be stored in case 1310.

The portable carrying and storage case 1410 of the fifteenth embodiment of FIG. 35 is substantially similar to the portable carrying and storage case 1310 of the fourteenth embodiment of FIGS. 32–34, and accordingly, the same elements are referenced by the same numerals, but augmented by 100, and a detailed discussion of these common elements is thereby omitted. Therefore, only the differences will be discussed.

The primary difference is that lower case section 1412 is made much deeper than lower case section 1312, and can be used as a picnic freezer. Because cover 1434 is removable, cover 1434 can be broken away to carry it to a table, desk or work surface. Also, handles 1480 are provided on the outer surfaces of side walls 1420 and 1422 because of the larger size. Also, recess 1327 and finger 1386 are eliminated. The walls can be made double-walled with an air space therebetween (to provide insulation), as shown in FIG. 35. Alternatively, the thick walls of the lower case section can be made of insulating material, such as styrofoam. The air space in upper portion 1436 also serves as insulation.

Having described specific preferred embodiments of the invention with reference to the accompanying drawings, it will be appreciated that the present invention is not limited to those precise embodiments, and that various features of the various embodiments can be modified and interchanged and used with other embodiments. Also, in the shown embodiments, any of the living hinges could be replaced with other fixed or breakaway hinges, and vice versa. The lock and dividers could be varied and/or interchanged. Various other changes and modifications can be effected therein by one of ordinary skill in the art without departing from the scope or spirit of the invention as defined by the appended claims.

What is claimed is:

1. A multi-part, multi-fold, multi-compartment portable carrying and storage case, comprising:

a lower case section including a first bottom wall and a first peripheral wall upstanding from a peripheral edge of said first bottom wall, with a first storage compartment defined within said first peripheral wall and said first bottom wall; and a case cover hingedly connected with said lower case section, said case cover including:

a first shell member hingedly connected with said lower case section for covering and closing said first compartment, said first shell member including a second bottom wall and a second peripheral wall upstanding from a peripheral edge of said second bottom wall, with a second storage compartment defined within said second peripheral wall and said second bottom wall; and a shell cover hingedly connected with said first shell member for covering and closing said second compartment, said shell cover including a third bottom wall and a third peripheral wall upstanding from a peripheral edge of said third bottom wall, and wherein said third peripheral wall seats on top of said second peripheral wall.

2. A case according to claim 1, further comprising an arrangement for detachably securing said shell cover to said first shell member in a closed condition.

3. A case according to claim 1, wherein said arrangement includes at least one recess in the peripheral wall of said first shell member and at least one hook in said shell cover for releasably engaging within said at least one recess.

4. A case according to claim 1, further comprising an arrangement for detachably securing said case cover to said lower case section in a closed condition.

5. A case according to claim 4, wherein said arrangement includes at least one recess in the peripheral wall of said lower case section and at least one hook in said case cover for releasably engaging within said at least one recess.

6. A case according to claim 1, wherein said case cover is hingedly connected with said lower case section and said first shell member is hingedly connected with said shell cover by hinges selected from the group consisting of living hinges and detachable hinges.

7. A multi-part, multi-fold, multi-compartment portable carrying and storage case, comprising:

a lower case section including a first bottom wall and a first peripheral wall upstanding from a peripheral edge of said first bottom wall, with a first storage compartment defined within said first peripheral wall and said first bottom wall; and a case cover hingedly connected with said lower case section, said case cover including:

a first shell member hingedly connected with said lower case section for covering and closing said first compartment, said first shell member including a second bottom wall and a second peripheral wall upstanding from a peripheral edge of said second bottom wall, with a second storage compartment defined within said second peripheral wall and said second bottom wall; and a shell cover hingedly connected with said first shell member for covering and closing said second compartment, said shell cover including an elongated opening therein for removing items stored in said second storage compartment.

8. A multi-part, multi-fold, multi-compartment portable carrying and storage case, comprising:

a lower case section including a first bottom wall and a first peripheral wall upstanding from a peripheral edge of said first bottom wall, with a first compartment defined within said first peripheral wall and said first bottom wall;

a shell member hingedly connected to one side of said first peripheral wall of said lower case section for covering and closing said first compartment; and a case cover member hingedly connected to said shell member for overlying and covering said shell member, with said case cover member including a second bottom wall and a second peripheral wall upstanding from a peripheral edge of said second bottom wall, and with said second peripheral wall engaging said shell member and wherein a second storage compartment is defined between said case cover member and said shell member, and said case cover member including an elongated opening therein for removing tissues in said second storage compartment.

9. A case according to claim 8, wherein said shell member includes a third bottom wall and a third peripheral wall that seats on the second peripheral wall.

10. A case according to claim 8, further comprising an arrangement for detachably securing said shell member to said lower case section in a closed condition.

11. A case according to claim 10, wherein said arrangement includes at least one recess in the first peripheral wall of said lower case section and at least one hook in said shell member for releasably engaging within said at least one recess.

12. A case according to claim 8, further comprising an arrangement for detachably holding said case cover member to said shell member.

13. A case according to claim 12, wherein said arrangement includes at least one recess in the peripheral wall of said shell member and at least one hook in said case cover member for releasably engaging within said at least one recess.

14. A case according to claim 8, wherein said shell member is hingedly connected with said lower case section by living hinges.

* * * * *